US006366063B1

(12) United States Patent
Sekii

(10) Patent No.: US 6,366,063 B1
(45) Date of Patent: Apr. 2, 2002

(54) CIRCUIT AND METHOD FOR DRIVING CAPACITIVE LOAD

(75) Inventor: Yoshizumi Sekii, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/814,090

(22) Filed: Mar. 21, 2001

(30) Foreign Application Priority Data

Mar. 22, 2000 (JP) ..... 12-081066

(51) Int. Cl.[7] ..... G05F 1/613
(52) U.S. Cl. ..... 323/223; 323/271; 327/111
(58) Field of Search ..... 323/220, 223, 323/265, 271; 327/108, 110, 111, 112; 345/211, 212

(56) References Cited

U.S. PATENT DOCUMENTS 4,767,959 A * 8/1988 Sakakibara et al. ..... 310/317
5,323,305 A * 6/1994 Ikeda et al. ..... 363/98
5,717,437 A * 2/1998 Sano et al. ..... 324/211
5,786,794 A * 7/1998 Kishi et al. ..... 345/60
5,936,598 A * 8/1999 Hayama et al. ..... 345/76
5,994,929 A * 11/1999 Sano et al. ..... 327/111
6,072,447 A * 6/2000 Noborio ..... 345/60

FOREIGN PATENT DOCUMENTS

JP 61-132997 6/1986 ..... G09G/3/30
JP 10-11019 1/1998 ..... G09G/3/28

* cited by examiner

*Primary Examiner*—Adolf Deneke Berhane
(74) *Attorney, Agent, or Firm*—Hayes, Soloway, Hennessey, Grossman & Hage, P.C.

(57) ABSTRACT

When a first switch is closed, a power-supply voltage V is applied to a serial resonance circuit that is made up of a coil and a capacitive load. When the voltage $V_c$ of the capacitive load exceeds the power-supply voltage V, a diode conducts a current, and thereby the voltage $V_c$ of the capacitive load is clamped at the power-supply voltage V, and resonance stops. As a result, a flywheel current flows through a closed loop that is made up of a coil, a first diode, and a first switch in a closed state, in this order. When the first switch is opened, the flywheel current has the loop shut off, and, therefore, the voltage of the serial resonance circuit falls rapidly in order to sustain or maintain the current, and falls below the earth potential so as to allow a second diode to conduct the current. Thereby, the flywheel current flows through the path that is made up of the second diode, the coil, and the first diode, and is regenerated to the power source, and the current energy saved in the coil is returned to the power source.

22 Claims, 26 Drawing Sheets

CIRCUIT AND METHOD FOR DRIVING CAPACITIVE LOAD

BACKGROUND OF THE INVENTION

1. Field of the Invention

This invention relates to a circuit and method for driving a capacitive load and, more particularly, to a driving circuit and driving method for a capacitive load suitable to drive a load that has a capacitance like an electrode of a dot matrix type display panel such as a plasma display panel and an EL display panel.

2. Description of the Related Art

In recent years, the need for a large-screen display device greater in size than a 40-inch type (102 cm diagonal) has risen as a process of improving a display device. This achievement will be difficult if such a large screen display device is constructed with a CRT (cathode ray tube). The reason is that its volume, weight, operating voltage, etc., becomes very large. Accordingly, a projection type display device and a reflection type display device have come into practical use as such large screen display devices. However, they are fundamentally inferior in display brightness, visual angle, color reproducibility, and depth, and have difficulty in following recent trends to construct a display device in the form of a flat panel and to realize a lightweight display device. In order to answer the marketing needs, demands have been made to develop and commercialize a self-luminous type large-screen plasma display device that has a flat display surface, that is light in weight, that is thin in depth, and that is excellent in visibility, such as the visual angle and color reproducibility. The rapid spread of the device is expected.

The plasma display device is made up of a panel portion (hereinafter designated simply as "panel" or in detail as "plasma display panel") for displaying an image by the use of a luminous discharge phenomenon and a driving circuit portion for driving this panel. According to differences in the discharge type, plasma display devices are classified into DC discharge types and an AC discharge types, and, according to differences in the electrode structure, they are classified into surface discharge types, opposition discharge types, two-electrode types, three-electrode types, etc. Among these types, the DC discharge type display device is constructed such that electrodes are exposed directly to a discharge space and, once an electric discharge occurs, a DC electric current continues running. By contrast, the AC discharge type display device is constructed such that an insulating layer lies between electrodes and a discharge gas, and therefore an electric current is restricted by the electrostatic capacity of the insulating layer, and, after a voltage is applied, the current runs for a short time of about one microsecond like a pulse and stops running. Since the insulating layer serves as a condenser, the AC discharge type display device repeats light emission and displays images by applying a bipolar AC pulse voltage to one of the electrodes or by alternately applying a pulse to both the electrodes.

The DC type display device is at a disadvantage in that, in spite of its simple structure, the electrodes deteriorate so significantly that the display device cannot maintain its long life because the electrodes are exposed directly to a discharge space on the other hand, the AC type display device is a t an advantage in t hat the lifetime thereof is long because the electrodes are covered with the insulating layer.

After all, these days, a method in which a surface discharge type plasma panel is allowed to undergo AC driving while separating a scanning electrode and a sustaining electrode from each other by the use of three kinds of electrodes is chiefly used among various plasma display methods that have been proposed until now. The reason is that, at the present time, this method is excellent in durability, is simple in structure, is relatively easy to aim at high definition/screen enlargement, and, in addition, is capable of easily realizing a luminescence maintaining function, called memory, that enables high-luminance light emission.

In any type, the plasma display panel is made up of two substrates facing each other, i.e., a front transparent substrate and a back substrate, a discharge gas space in which discharge gas, such as He—Xe or Ne—Xe, is filled and display cells are arranged in a matrix form at a gap between the substrates, and various stripe-shaped electrodes arranged perpendicularly to each other on each inner surface of the front transparent substrate and the back substrate. Electrodes on the side of the front transparent substrate and electrodes on the side of the back substrate are arranged to intersect at the position of each display cell.

Next, a description will be provided of a three-electrode surface discharge type panel structure as a representative of a plasma display panel of AC driving.

FIG. 1 is an exploded perspective view that separately shows the structure of a plasma display panel of the three-electrode surface discharge type, FIG. 2 is a cross-sectional view of the panel, FIG. 3 is an enlarged sectional view that shows a part of the panel by further enlarging it, FIG. 4 is a plan view that shows the electrode structure of the panel, and FIG. 5 is a plan view that shows the display cell structure of the panel.

As shown in FIGS. 1 to 5, in a panel 1 of the three-electrode surface discharge type, three kinds of display cells Cr, Cg, and Cb are disposed on the inner surface of a front transparent substrate 2. The display cells Cr, Cg, and Cb serve to produce the colors of red, green, and blue, respectively. The display cells Cr, Cg, and Cb are arranged in the direction of columns. The column of the display cell Cg is disposed next to the column of the display cell Cr, and the column of the display cell Cb is disposed next to the column of the display cell Cg. Thus, the column of the display cell Cr, the column of the display cell Cg, and the column of the display cell Cb are disposed repeatedly in the direction of rows. Further, in the plasma display panel, there are formed a lot of surface discharge electrode pairs that are made by pairs of a plurality of transparent scanning electrodes S1, S2, . . . (hereinafter designated generically as "scanning electrode S") and a plurality of transparent sustaining electrodes Su1, Su2, . . . (hereinafter designated generically as "sustaining electrode Su"). The scanning electrode S and the sustaining electrode Su extend in the row wise direction. Each scanning electrode S and each sustaining electrode Su are disposed to pass through the display cells arranged in the row wise direction. The scanning electrode S (S1, S2, . . . ) and the sustaining electrode Su (Su1, Su2, . . . ) are each made of a transparent conductive thin film, such as ITO (Indium Tin Oxide) or $SnO_2$. In order to supply a sufficient electric current to the scanning electrode S and the sustaining electrode Su, a bus electrode B made of, for example, a silver thick film is disposed at one side end of the surface of each of the scanning electrode S and the sustaining electrode Su. The surfaces of the scanning electrode S and the sustaining electrode Su that are each provided with the bus electrode B are covered with a transparent dielectric layer 3. An MgO protective layer 4 to protect the dielectric layer 3 from ion bombardment during a discharge is further placed on the transparent dielectric layer 3.

On the inner surface of the back substrate 6, stripe-shaped partitions 7 are disposed between columns that are constructed of the display cells. The partitions 7 define a stripe-shaped discharge gas space that divides the columns of the display cells and extends in the column wise direction. A plurality of data electrodes (column electrodes) D1, D2 . . . (hereinafter designated generically as "data electrode D") are further disposed on the plasma display panel. The data electrode D extends in the column wise direction. Each data electrode D is disposed to pass through each of the columns of the display cells Cr, Cg, and Cb arranged in the column wise direction. A dielectric layer 8 is formed on the data electrodes D that are each made of, for example, a silver film and are connected in the column wise direction per column of each of the display cells Cr, Cg, and Cb in the discharge gas space. Three kinds of fluorescent materials 9*r*, 9*g*, and 9*b* by which ultraviolet rays generated by a discharge in the discharge gas are converted into visible rays of R, G, and B colors are placed in the form of a stripe on a sectionally channel-shaped groove surface of the discharge gas space that is defined by the dielectric layer 8, the partition 7, and the next partition 7.

Thus, the plasma display panel 1 of the three-electrode surface discharge type is constructed such that, as shown in FIG. 3, the surface discharge electrode pair consisting of the pair of the scanning electrode S and the sustaining electrode Su and the data electrode D intersect with each other at the part of each display cell Cr, Cg, and Cb, and the repetitive unit of the display cells Cr, Cg, and Cb of the R, G, and B colors that are arranged in the row wise direction with the partition 7 therebetween is represented as one pixel. The display cells Cr (Cg, Cb) having the same color are arranged in the column wise direction. For example, in a 42-inch type (106 cm diagonal) panel 1 used as a large-screen three-electrode surface discharge type panel, 480 scanning electrodes S that extend in the row wise direction are disposed, 480 sustaining electrodes Su that similarly extend in the row wise direction are disposed, and 2559 data electrodes D that extend in the column wise direction are disposed. The number of pixels in the column wise direction of this panel is 480, the number of pixels in the row wise direction is 853, and the pitch of each pixel is about 1 mm both in the row wise direction and in the column wise direction.

Next, a description will be provided of a driving circuit portion for driving the plasma display panel 1.

FIG. 6 is a block diagram that shows a circuit structure of an AC drive plasma display panel of the three-electrode surface discharge type and a driving circuit thereof. The driving circuit portion applies a voltage pulse between a data electrode D and a scanning electrode S and causes a write discharge so as to form wall charges on the scanning electrodes S of the display cells Cr, Cg, and Cb. As a result, the display cell having the wall charge on its scanning electrode generates a sustaining discharge when a sustaining discharge operation, described later, is carried out. Voltage pulses for generating a sustaining discharge in such an arbitrary display cell are called lighting indicative data, and the operation of forming a wall charge on the scanning electrode S of the arbitrary display cell and writing the lighting indicative data is called writing operation. The driving circuit portion is designed to carry out display driving by a combination with a so-called sustaining discharge operation (see FIGS. 9(*a*) and 9(*b*)) for alternately applying a sustaining pulse between the scanning electrode S and the sustaining electrode Su and allowing only the display cells Cr, Cg, and Cb on which wall charges are formed to sustain a luminous discharge after the writing operation is completed.

In order to achieve this two-stage driving (scanning/sustaining separation driving), the driving circuit portion is made up of a drive timing control circuit 10, a data electrode driving circuit 11, an indicative data control circuit 12, a data electrode driving element 13, a scanning electrode driving circuit 14, a scanning electrode driving element 15, a sustaining electrode driving circuit 16, and a power supply for driving 17, as shown in FIG. 6.

The function of each constituent of the driving circuit portion will be described in detail. As shown in FIG. 6, the drive timing control circuit 10 first generates various timing pulses necessary to drive the panel 1 on the basis of a vertical synchronizing signal that is an input signal transmitted from the indicative data control circuit 12, and then controls a sequence to control and drive the entire panel. It should be noted that, for gradation display, one field period is constructed by a plurality of periods (subfield) different in the number of pulses that are applied for a sustaining (operating) period in the plasma display device, and the timing of the subfield at this time is also controlled by the drive timing control circuit 10.

The data electrode driving circuit 11 generates a data pulse train on the basis of a clock signal supplied from the drive timing control circuit 10, and supplies it to the data electrode driving element 13.

The indicative data control circuit 12 that includes a frame memory processes input indicative data that have given, thereafter generates write data (lighting indicative data) about all the display cells Cr, Cg, and Cb per subfield, and makes the serial transfer of the generated write data to the data electrode driving element 13 at high speed.

FIG. 7 shows various driving waveforms in one subfield. As shown in FIG. 6 and FIG. 7, the data electrode driving element 13 is made up of a shift register for applying a serial-parallel conversion to the write data supplied from the indicative data control circuit 12 and a high-pressure resistance switching element group of a C-MOS structure connected to the data electrodes D by one-to-one. When it receives an enabling signal indicating the delimitation of the write data from the drive timing control circuit 10, the data electrode driving element 13 simultaneously and in one lump drives the data electrodes D on the basis of the write data about one row of the display cells Cr, Cg, and Cb where inputting has been completed. In other words, data pulses Rd1, Rd2, . . . Rdn (see (e) of FIG. 7) supplied from the data electrode driving circuit 11 are simultaneously applied to all the data electrodes D that pass through the display cells Cr, Cg, and Cb having the command of "Lighting".

The drive timing control circuit 10 periodically outputs various ON/OFF signals every one subfield. when the supply of these ON/OFF signals is input, the scanning electrode driving circuit 14 sequentially generates a preliminary discharge pulse Pp, a preliminary discharge deletion pulse Pd, bas e pulses Pb1, Pb2, . . . Pbn, and a sustaining pulse train Pm, according to the kind of the signal, and supplies them to the scanning electrode driving element 15 (see (b), (c), and (d) of FIG. 7).

When various batch synchronizing signals supplied from the drive timing control circuit 10 are received, the scanning electrode driving element 15 simultaneously applies the preliminary discharge pulse Pp, the preliminary discharge deletion pulse Pd, the sustaining pulse train Pm that are sequentially supplied from the scanning electrode driving circuit 14 to all the scanning electrodes S according to the kind of the signal, and drives the scanning electrodes S in the lump. At the same time, during a writing period for the lighting indicative data, the scanning electrode driving element 15 sequentially and selectively scans the scanning electrodes S while responding to a horizontal synchronizing signal (shift pulse) supplied from the drive timing control circuit 10, and applies scanning pulses (row selection pulses) Ps1, Ps2, . . . Psn to selected scanning electrodes Sn (see (b), (c), and (d) of FIG. 7).

On receiving the supply of various ON/OFF synchronizing signals, which take a round every one subfield, from the drive timing control circuit 10, the sustaining electrode driving circuit 16 sequentially generates a preliminary discharge pulse Qp, a sustaining pulse Qm, a sustaining deletion pulse Qd according to the kind of the signal, and simultaneously applies the generated pulses to all the sustaining electrodes Su so as to perform the batch driving of the sustaining electrodes Su (see (a) of FIG. 7).

The power supply 17 supplies necessary power to the data electrode driving circuit 11, the scanning electrode driving circuit 14, and the sustaining electrode driving circuit 16.

Next, a description will be provided of a method of performing gradation display by the use of the above-mentioned plasma display panel. Unlike other devices, in the plasma display panel, it is difficult to perform the gradation display of brightness according to a change in an applied voltage because the relationship between the applied voltage and the brightness is not linear. Therefore, in general, the gradation display is performed by controlling the frequency of light emission. Especially in the gradation display of brightness, a subfield method, described later, is used.

FIG. 8 shows a driving sequence under the subfield method, where the horizontal axis indicates time, and the vertical axis indicates scanning electrodes S1, S2, . . . Sn. One image is sent during one field. The time of one field depends on each individual computer and a broadcasting system, and is often set within the range of roughly 1/50 to 1/75 seconds. In the gradation image display of the plasma display panel, one field is divided into k subfields as shown in the figure. In FIG. 8, for example, one field is divided into six subfields of SF1, SF2, . . . and SF6.

As shown in FIG. 8, each of the subfields SF1, SF2, . . . SF6 is made up of a write period for writing lighting indicative data on the display cells Cr, Cg, and Cb by a scanning pulse and a data pulse and a sustaining discharge period for lighting and displaying only the display cells Cr, Cg, and Cb on which the lighting indicative data has been written. As shown in FIG. 8, during the write period, an erasing discharge for erasing the lighting indicative data written on a previous subfield or a compulsory preliminary discharge is carried out, and thereafter a voltage pulse is applied to the data electrodes D and the scanning electrodes S so as to generate a write discharge. Wall charges are formed on the scanning electrodes S of the display cells Cr, Cg, and Cb on which the lighting indicative data is written by the discharge.

During the sustaining discharge period following the write period, only the display cells on which the lighting indicative data has been written are lit and displayed by applying an AC sustaining pulse between the scanning electrode S and the sustaining electrode Su.

Assuming that "n" is a subfield number, the subfield with the lowest brightness is defined as "1", and the subfield with the highest brightness is defined as "k". L1 is the brightness (number of times of light emission) of the subfield lowest in brightness, "an" is a variable that takes the value of "1" or "0", and, in the n-th subfield ("th" is a suffix forming an ordinal number), "1" indicates a case where the display cells Cr, Cg, and Cb are lit, and "0" indicates a case where those cells are not lit. Brightness can be controlled while selecting the lighting/non-lighting of the display cells Cr, Cg, and Cb per subfield by allowing the luminous brightness to differ between subfields in this way.

As a result, if the luminous brightness of each of the display cells Cr, Cg, and Cb is represented as I, the luminous brightness I is controlled according to Equation (1) in which the number of times of light emission of a sustaining discharge of each of the display cells Cr, Cg, and Cb in each subfield is weighted by 2n.

$$I = \sum_{n=1}^{k} (L_1 \times 2^{n-1}) \times a_n \tag{1}$$

Since the repetitive unit of the display cells Cr, Cg, and Cb of the R, G, and B colors is defined as one pixel when images are displayed in colors, the gradation of $2^k=2^6=64$ stages can be expressed by each color if k=6. Concerning a pigment, $64^3=262144$ colors including black can be displayed. If k=1, one field is equal to one subfield, and two-gradation (ON or OFF) display can be performed about each color. Concerning the number of colors, $2^3=8$ colors including black can be displayed.

Next, various driving waveforms in one subfield will be described with reference to FIG. 7. A preliminary discharge pulse (positive pulse) Pp, a preliminary discharge deletion pulse Pd, and a sustaining pulse Pm, which are common to scanning electrodes S (S1, S2, . . . , Sn), are applied to these scanning electrodes, and, in writing and scanning, scanning pulses Ps1, Ps2, . . . , Psn are sequentially applied to the scanning electrodes S1, S2, . . . , Sn, respectively, with independent timing. That is, the scanning pulse Ps1 is first applied to the scanning electrode S1, the scanning pulse Ps2 is then applied to the scanning electrode S2, and thereafter the scanning pulse Ps3 is applied to the scanning electrode S3. When one scanning electrode is selected, scanning base pulses Pb1, Pb2, . . . , Pbn are applied to the remaining scanning electrodes that have not been selected.

As shown in (a) of the figure, during a preliminary discharge, a preliminary discharge pulse Qp (negative pulse) is applied to the sustaining electrode Su synchronously with the preliminary discharge pulse Pp (positive pulse) to be applied to the scanning electrodes S1, S2, . . . , Sn. During a sustaining discharge, a sustaining pulse Qm is applied thereto with timing that is alternated with the timing with which a sustaining pulse Pm is applied to the scanning electrodes S1, S2, . . . , Sn. When the sustaining discharge is completed, a sustaining deletion pulse Qd is applied thereto. As shown in (e) of the figure, if there are lighting-indicative data to be written in the writing, data pulses Rd1, Rd2, . . . , Rdn are applied to the data electrode D synchronously with the scanning pulses Ps1, Ps2, . . . , Psn.

Next, the subfield operation of a three-electrode surface discharge type plasma display device will be described with reference to FIG. 9. FIG. 9 shows the subfield operation of the three-electrode surface discharge type plasma display device.

(1) Sustaining discharge deletion ((c) of FIG. 9)

First, the sustaining electrode driving circuit 16 applies the sustaining deletion pulse Qd to the sustaining electrode Su with timing directed by the drive timing control circuit 10, and deletes the discharge of the display cells Cr, Cg, and Cb that have emitted light in an immediately previous subfield. As a result, an extra wall charge that causes noise is deleted.

(2) Preliminary discharge ((d) of FIG. 9)

Thereafter, the scanning electrode driving element 15 and the sustaining electrode driving circuit 16 alternately apply positive and negative preliminary discharge pulses Pp and Qp to all the scanning electrodes S and the sustaining electrodes Su with timing simultaneously directed by the drive timing control circuit 10 so as to generate a voltage between both the electrodes, and thereby cause all the display cells Cr, Cg, and Cb to compulsorily discharge once.

(3) Preliminary discharge deletion ((e) of FIG. 9)

Immediately thereafter, the scanning electrode driving element 15 applies a preliminary discharge deletion pulse Pd to all the scanning electrodes S with the timing directed by the drive timing control circuit 10, and deletes the preliminary discharge. As a result, active particles are injected into a discharge space, and a write discharge by scanning pulses Ps1, Ps2, . . . , Psn to be subsequently applied is liable to easily occur.

(4) Write discharge ((f) of FIG. 9)

After the preliminary discharge is deleted, the data electrode driving element 13 and the scanning electrode driving element 15 apply scanning pulses Ps1, Ps2, . . . , Psn, and data pulses Rd1, Rd2, . . . , Rdn between selected scanning electrodes S1, S2, . . . , Sn, and data electrodes D1, D2, . . . , Dn with timing, i.e., shift timing simultaneously directed by the drive timing control circuit 10. As a result, the display cells Cr, Cg, and Cb on which the lighting indicative data is to be written undergo a selective discharge, and wall charges are formed on the scanning electrodes S of the display cells Cr, Cg, and Cb subjected to the selective discharge. Thus, the lighting indicative data is written in the form of the wall charges formed thereon. If only the scanning pulses Ps1, Ps2, . . . , Psn or only the data pulses Rd1, Rd2, . . . , Rdn are applied, the write discharge does not occur, and neither does the subsequent sustaining discharge occur.

(5) Sustaining discharge ((a) and (b) of FIG. 9)

After the completion of the write discharge, the scanning electrode driving element 15 and the sustaining electrode driving circuit 16 alternately apply sustaining pulses Pm and Qm to the scanning electrode S and the sustaining electrode Su with application timing alternately supplied by the drive timing control circuit 1, and cause only the wall-charge forming display cells Cr, Cg, and Cb to maintain the sustaining discharge (luminous discharge) between the sustaining electrode Su and the scanning electrode S that adjoin each other. One subfield operation is completed through these procedures. When the one subfield operation is completed, the stage proceeds to a subsequent subfield operation, and the above-mentioned cycle operation is repeated. The luminous brightness in each subfield is controlled by the number of times of repetition of the sustaining discharge.

In general, a dot matrix type display panel forms a lot of row electrodes and column electrodes, and forms display pixels or display cells in a crossing area of them. Therefore, the sum total of the electrostatic capacity that exists between facing electrodes or parallel electrodes reaches a large amount. For this reason, when the dot matrix type display panel is driven, a necessary operating voltage cannot be applied to each display element if the charge of the electrostatic capacity is not completed. An electric power part used only to charge the device with the electrostatic capacity is different from the electric power actually consumed. If the power part can be recovered in an appropriate way, it is reusable. Therefore, it is generally called reactive power.

Since a luminous discharge phenomenon is used especially in the plasma display panel, a driving voltage to be applied is high, and reactive power proportionately increases. Further, in AC driving, electric power that accompanies the movement of a wall charge remaining on the wall surface of a dielectric also corresponds to reusable reactive power that is the same in quality as the charging electric power toward the electrostatic capacity, and therefore the reactive power increases even more.

In order to overcome this disadvantage, an attempt has been made to reduce power consumption in such a way as to regain charging electric power with which a capacitive load is charged and to reuse it (electrically revive it). For example, Japanese Unexamined Patent Publication No. 132997 of 1986 (hereinafter designated as "first prior art") provides a means for regenerating a charge stored in an electrostatic capacity into an original power supply and reusing it. Further, Japanese Unexamined Patent Publication No. 11019 of 1998 (hereinafter designated as "second prior art") discloses a means for regenerating a charge stored in an electrostatic capacity into an exclusive regenerating condenser and reusing it.

First, a description will be provided of the basic circuit of the first prior art and the operation of the circuit. FIG. 10 is a circuit diagram that shows the basic structure of a sustaining pulse generation circuit provided with an electric power regenerating function according to the first prior art, and FIG. 11 is a timing chart for describing the operation of the circuit. The sustaining pulse generation circuit is to generate a sustaining pulse and supply it to a sustaining electrode or to a scanning electrode, and, as shown in FIG. 10, the circuit is made up of high-voltage switches $SW_{11}$, $SW_{12}$, $SW_{13}$, $SW_{14}$, diodes $DI_{11}$, $DI_{12}$, $DI_{13}$, $DI_{14}$, a coil $L_{11}$ for electric-power recovery, and an external capacity $C_{12}$ including a stray capacity and the like in the circuit. In the figure, $C_{11}$ designates a condenser of a DC power source output, $C_{13}$ designates a capacitive load that includes dissimilar/similar electrodes (various panel electrodes) of the plasma display panel, $TP_1$ designates an output terminal of the sustaining pulse generation circuit, and $TP_2$ designates a terminal for connecting a DC power source that supplies a voltage VS.

Next, referring to FIG. 10 and FIG. 11, a description will be provided of the operation of the sustaining pulse generation circuit constructed as above. First, at time $T_{11}$, the switch $SW_{14}$ is opened ((d) of FIG. 11), and the switch $SW_{11}$ is closed ((a) of FIG. 11) in order to feed a sustaining pulse voltage, and the external capacity $C_{12}$ and the capacitive load $C_{13}$ are charged through the coil $L_{11}$. At time $T_{12}$ when the voltage of the terminal $TP_1$ exceeds the voltage VS of the connecting terminal $TP_2$ of the DC power source, the diode $DI_{13}$ conducts a current, and the voltage of the terminal $TP_1$ is clamped at the voltage VS of the terminal $TP_2$ ((e) of the figure). Thereafter, when the switch $SW_{11}$ is opened ((a) of the figure) in accurate synchronization with time $T_{12}$, the energy saved in the coil L11 is regenerated into the condenser $C_{11}$ connected to the terminal $TP_2$ through the coil $L_{11}$, the diode $DI_{13}$, the condenser $C_{11}$, and the diode $DI_{12}$.

Thereafter, at time $T_{12}$ when the voltage of the terminal $TP_1$ exceeds the voltage of the terminal $TP_2$, the switch $SW_{13}$ is closed ((c) of the figure), and the terminal $TP_1$ is connected to the DC power source so as to fix the voltage of the terminal $TP_1$ at the sustaining pulse voltage VS.

Thereafter, at time $T_{13}$, the switch $SW_{13}$ is opened ((c) of the figure), and, at the same time, the switch $SW_{12}$ is closed ((b) of the figure) so as to remove the sustaining pulse voltage VS. Thereby, the voltage of the terminal $TP_1$ drops to 0 voltage through the coil $L_{11}$. At time $T_{14}$ when the voltage of the terminal $TP_1$ becomes less than 0 voltage, the diode $DI_{14}$ conducts a current, and the terminal $TP_1$ is clamped at 0 voltage ((e) of the figure). Thereafter, when the switch $SW_{12}$ is opened accurately synchronizing with time $T_{14}$ ((b) of the figure), the energy saved in the coil $L_{11}$ is regenerated into the condenser $C_{11}$ connected to the terminal $TP_2$ through the coil $L_{11}$, the diode $DI_{11}$, the condenser $C_{11}$, and the diode $DI_{14}$.

Thereafter, at time $T_{14}$ when the voltage of the terminal $TP_1$ is under 0 voltage, the switch $SW_{14}$ is closed ((d) of the figure), and the terminal $TP_1$ is connected to an earth terminal so as to fix the voltage of the terminal $TP_1$ at 0 voltage.

Next, a description will be provided of the basic circuit of the second prior art and the operation of the circuit. FIG. 12 is a circuit diagram that shows the basic structure of the sustaining pulse generation circuit provided with an electric-power regenerating function according to the second prior art, and FIG. 13 shows waveforms of an electric current by an output voltage and an electromotive force of a coil for explaining the operation of this circuit.

As shown in FIG. 12, the sustaining pulse generation circuit roughly comprises a charge regenerating portion 19 that includes a condenser $C_{21}$ for regenerating energy, a coil $L_{21}$, and switching means 18 connected in series, a first clamping means 21, provided with a switch $SW_{21}$, for clamping a panel electrode 20 (for example, a sustaining electrode or a scanning electrode) that constructs a capacitive load Cp at a power-supply voltage Vcc, a second clamping means 22, provided with a switch $SW_{22}$, for clamping the panel electrode 20 at an earth potential, and first and second driving means 23, 24 for driving the first or second clamping means 21, 22 by detecting that an electric current through the coil $L_{21}$ has flowed backward.

As shown in FIG. 12, the switching means 18 is constructed such that a combination of the switch $SW_{23}$ and the diode $DI_{21}$ that are connected in series with each other and a combination of the switch $SW_{24}$ and the diode $DI_{22}$ opposite in direction to the diode $DI_{21}$ that are connected in series with each other are connected in parallel with each other. Accordingly, when the electric current flowing through the coil $L_{21}$ reaches zero (0), the switching means 18 is turned "OFF". In the sustaining pulse generation circuit, the sustaining pulse generation circuit connected to the scanning electrode and the sustaining pulse generation circuit connected to the sustaining electrode are disposed as a pair.

Next, referring to FIG. 12 and FIG. 13, a description will be provided of the operation of the sustaining pulse generation circuit constructed as above. On the assumption that the terminal voltage Vss of the condenser $C_{21}$ for regenerating energy is Vcc/2 (half the power-supply voltage), the voltage Vp between the terminals of the capacitive load Cp is 0, the switches $SW_{21}$ and $SW_{23}$ are each in an open state, and the switches $SW_{22}$ and $SW_{24}$ are each in a closed state (i.e., State 0), the stage proceeds from State 0 to State 1.

(1) State 1

First, the switch $SW_{21}$ is closed, the switch $SW_{22}$ is opened, and the switch $SW_{24}$ is opened. When the switch $SW_{21}$ is closed, a serial resonance circuit is formed with the coil $L_{21}$ and the capacitive load Cp. At this time, the terminal voltage Vss of the condenser $C_{21}$ has a forcing voltage of Vcc/2. Thereafter, the terminal-and-terminal voltage Vp of the capacitive load Cp rises to the power-supply voltage Vcc. At this time, an electric current IL by the electromotive force of the coil is 0, and the diode $DI_{21}$ reaches a reverse-bias state.

(2) State 2

The switch $SW_{23}$ is closed, and the terminal-and-terminal voltage Vp of the capacitive load Cp is clamped at the power-supply voltage Vcc, so that a discharge current path is brought to all the display cells that are to be turned "ON".

(3) State 3

The switch $SW_{22}$ is closed, the switch $SW_{21}$ is opened, and the switch $SW_{23}$ is opened. When the switch $SW_{22}$ is closed, a serial resonance circuit is again formed with the coil $L_{21}$ and the capacitive load Cp, and, at this time, the terminal voltage Vss of the condenser $C_{21}$ has a forcing voltage of Vcc/2. Thereafter, the terminal-and-terminal voltage Vp of the capacitive load Cp falls to the earth potential. At this time, the electric current IL by the electromotive force of the coil is 0, and the diode $DI_{22}$ reaches a reverse-bias state.

(4) State 4

The switch $SW_{24}$ is closed, and the terminal-and-terminal voltage Vp of the capacitive load Cp is clamped at the earth potential. At this time, another sustaining pulse generation circuit that is paired with this sustaining pulse generation circuit drives the panel electrode, which is situated on the opposite side and is a constituent element of the capacitive load Cp, to the power-supply voltage Vcc. If there is a display cell to be turned "ON", a discharge current flows through the switch $SW_{24}$.

Both the first prior art and the second prior art intend to reduce the reactive power in such a way as to regenerate the charging/discharging power of the electrostatic capacity and reuse it as described above.

However, the first prior art has problems in that, the sustaining pulse generation circuit has four switches $SW_{11}$, $SW_{12}$, $SW_{13}$ and $SW_{14}$, therefore the circuit structure of the sustaining pulse generation circuit increase in complexity, and in order to efficiently regenerate electric power, the opening/closing of each switch must be accurately controlled according to timing with which the voltage of the capacitive load is clamped at the power-supply voltage and at the earth potential. Further, the second prior art has a problem in that the switches used to clamp the voltages must be opened and closed with accurate timing. If the timing is inaccurate, a large gas discharge current also flows through a driving circuit, such as the sustaining pulse generation circuit, and, for this reason, a power loss in the driving circuit increases, and the regenerating efficiency of the charging/discharging power greatly declines, and, in the worst case, there is fear that the diodes and the switches will be burnt out.

However, in the plasma display panel, the rise time and the fall time of a sustaining pulse are each about 0.2 to 0.5 $\mu$s (microseconds), and therefore the driving circuit is required to work at an extremely high speed. Preferably, the operational delay time is below 0.1 $\mu$s, for example. However, in the present circumstances, there is no switching device of the high-power type/high-pressure resistance type that has an operational speed high enough to perform an accurate ON-operation only during the rise time or only during the fall time. Additionally, if such a switching device is developed, it will require enormous cost.

Accordingly, if a circuit having a good timing characteristic is constructed by the use of a cheap switching device having an inferior characteristic, the resulting circuit will have an extremely complex circuit structure, and, after all, become expensive. This circuit is inconvenient.

Additionally, the gas discharge current flowing through the driving circuit is not constant, and the number of pixels that emit light per subfield changes according to input indicative data. An equivalent electrostatic capacity also changes according to a change in this display percentage, and, in addition, the resonance frequency of the resonance circuit with the coil changes. Therefore, it becomes increasingly difficult to control various switches so that the opening/closing timing of the switches exactly coincides with each other.

Further, since a high-speed transient occurs in voltage clamping, unnecessary electromagnetic-wave radiation is large.

SUMMARY OF THE INVENTION

It is an object of the present invention to provide a circuit and method for driving a capacitive load, that is low cost, and is capable of regenerating reactive power practically sufficiently although its circuit structure is simple, and that is capable of reducing unnecessary electromagnetic-wave radiation.

A driving circuit for a capacitive load, which supplies a pulse to the capacitive load that is an electrode of a capacitive display panel according to the present invention comprises a coil connected in series directly or indirectly to the capacitive load and making up a serial resonance circuit together with the capacitive load; a first switch for applying a DC power source voltage output from a DC power source to the serial resonance circuit and causing first resonance to begin by closing the first switch; a first clamping circuit for stopping the first resonance by clamping a voltage of the capacitive load at the DC power source voltage at time at which the voltage of the capacitive load begins to exceed the DC power source voltage after the first resonance starts; a first flywheel current control circuit for bringing a current flowing through the coil into a first flywheel operational state and sustaining it when the first resonance stops; a first electric-current regenerating circuit for regenerating the current in the first flywheel operational state to the DC power source; a second switch for causing the serial resonance circuit to begin second resonance, with a charging voltage of the capacitive load as a source, by closing the second switch; a second clamping circuit for clamping the voltage of the capacitive load at earth potential and stopping the second resonance at the time at which the voltage of the capacitive load begins to fall below the earth potential after the second resonance begins; a second flywheel current control circuit for bringing the current flowing through the coil into a second flywheel operational state and sustaining it when the second resonance stops; and a second electric-current regenerating circuit for regenerating the current of the second flywheel operational state to the DC power source.

The first electric-current regenerating circuit can regenerate a part of the current in the first or second flywheel operational state to the DC power source in accordance with input timing of a regenerating pulse, and thereafter regenerate a remainder of the current that continues the first or second flywheel operation to the DC power source.

Further, the first electric-current regenerating circuit can include a third switch, and regenerate the current in the first flywheel operational state to the DC power source when the third switch is closed.

Further, the second electric-current regenerating circuit can include a fourth switch, and regenerate the current in the second flywheel operational state to the DC power source when the fourth switch is closed.

The driving circuit of the capacitive load further comprises a load capacity one end of which is connected between the coil and the capacitive load and the other end is connected to the earth potential.

Further, the first clamping circuit includes a first diode connected so that a direction from the coil to the DC power source is a forward direction between the DC power source and a wiring line connecting the coil and the capacitive load, and the second clamping circuit includes a second diode connected so that the direction from an earth terminal to the coil is a forward direction between the wiring line and the earth terminal.

The first flywheel current control circuit is a closed loop made up of a coil, a first diode, and a first switch in the closed state that are connected in this order and in series, the first diode is connected so that the direction of this order is a forward direction, and a control circuit that control the operations of the first and second switches, and the second flywheel current control circuit is a closed loop made up of the coil, a second switch in the closed state and a second diode that are connected in this order and in series, a second diode connected so that a direction of this order is a forward direction, and a control circuit that control the operations of the first and second switches, and the currents in the first and second flywheel operational states flow through the coil in the opposite direction to each other.

The first electric-current regenerating circuit made up of a third diode connected in parallel with the second switch in the open state, a coil, and a first diode that are connected in this order and in series, the third and first diodes connected so that the direction of this order is a forward direction, is interposed between the DC power source and an earth terminal, and the second electric-current regenerating circuit made up of a second diode, a coil, and a fourth diode connected in parallel with the first switch in the open state that are connected in this order and in series, the second and fourth diodes connected so that the direction of this order is a forward direction, is interposed between the DC power source and an earth terminal, and, when the first switch is opened in the case of the second switch is opened, the first electric-current regenerating circuit reaches a current regenerating state, whereas when the second switch is opened in the case of the first switch is opened, the second electric-current regenerating circuit reaches a current regenerating state.

A driving circuit for a capacitive load, which supplies a pulse to the capacitive load that is an electrode of a capacitive display panel according to the present invention comprises: a coil connected directly or indirectly to the capacitive load and making up a serial resonance circuit together with the capacitive load; a first diode connected so that the direction from the coil to the DC power source is a forward direction between one end of the coil on a side of the capacitive load and the DC power source; a second diode connected so that the direction from an earth terminal to the coil is a forward direction between the end of the coil and the earth terminal; a third diode connected so that the direction from the coil to the DC power source is a forward direction between the other end of the coil and the DC power source; a first switch connected in parallel with the third diode; a fourth diode connected so that the direction from the earth terminal to the coil is a forward direction between the other end of the coil and an earth terminal; a second switch connected in parallel with the fourth diode; and a control circuit that control the operations of the first and second switches.

A parallel connection part of the third diode and the first switch and a parallel connection part of the fourth diode and the second switch can be each constructed by a MOSFET including a parasitic diode.

Further, in the driving circuit of the capacitive load, the DC power source voltage is at a lower side than the earth potential, and, instead of the first clamping circuit, a third clamping circuit is provided for clamping the voltage of the capacitive load at the DC power source voltage when the voltage of the capacitive load begins to fall below the DC power source voltage and stopping the first resonance after the first resonance begins, and, instead of the second clamping circuit, a fourth clamping circuit is provided for clamping the voltage of the capacitive load at the earth potential and stopping the second resonance when the voltage of the capacitive load begins to exceed the earth potential and stopping the second resonance after the second resonance begins.

A driving circuit of a capacitive load has two driving circuits, and the two driving circuits are disposed at both sides of the capacitive load, respectively.

A driving method for supplying a pulse train to a capacitive load that is an electrode of a capacitive display panel by the use of the aforementioned driving circuit for the capacitive load includes the steps of, at first time point, closing the first switch and applying the DC power source voltage to the serial resonance circuit so as to begin the first resonance; at second time point at which the voltage of the capacitive load begins to exceed the DC power source voltage after the first resonance begins, clamping a charging voltage of the capacitive load at the DC power source voltage so as to stop the first resonance, and, at this time, sustaining the current flowing through the coil in a first flywheel operational state; at the third time point, opening the first switch and regenerating the current in the first flywheel operational state to the DC power source; at fourth time point, closing the second switch and applying the charging voltage of the capacitive load to the serial resonance circuit so as to begin the second resonance; at fifth time point at which the voltage of the capacitive load begins to fall below the earth potential after the second resonance begins, clamping the voltage of the capacitive load at the earth potential so as to stop the second resonance and, at this time, sustaining the current flowing through the coil in a second flywheel operational state; and at the sixth time point, opening the second switch and regenerating the current in the second flywheel operational state to the DC power source, and supplying a pulse train to the capacitive load by repeating a series of operations from the first time point to the sixth time point.

The regenerating to the DC power source of the current in the first flywheel operational state by opening the first switch at the third time point can be carried out such that the first switch is caused to be in an open state during a predetermined time, and, during this time, a part of the current in the first flywheel operational state is regenerated to the DC power source, and thereafter the first switch is again opened, and the remaining current that continues the first flywheel operation is regenerated to the DC power source.

Further, the regenerating to the DC power source of the current in the second flywheel operational state by opening the second switch at the sixth time point can be carried out such that the second switch is caused to be in an open state during a predetermined time, and, during this time, a part of the current in the second flywheel operational state is regenerated to the DC power source, and thereafter the second switch is again opened, and the remaining current that continues the second flywheel operation is regenerated to the DC power source.

A time point at which the first switch is brought into an open state can be controlled according to a load capacity of the capacitive load.

Further, a time point at which the second switch is brought into an open state can be controlled according to a load capacity of the capacitive load.

Further, a time width of the open state of the first switch can be controlled according to a load capacity of the capacitive load.

Further, a time width of the open state of the second switch can be controlled according to a load capacity of the capacitive load.

The first current regenerating circuit includes a third switch, and, at the third time point, the regenerating to the DC power source of the current in the first flywheel operational state by opening the first switch is carried out such that, at the third time point, the third switch is closed, and the current in the first flywheel operational state is regenerated to the DC power source.

The second current regenerating circuit includes a fourth switch, and, at the sixth time point, the regenerating to the DC power source of the current in the second flywheel operational state by opening the second switch is carried out such that, at the sixth time point, the fourth switch is closed, and the current in the second flywheel operational state is regenerated to the DC power source.

The driving circuit of the capacitive load further includes a load capacity one end of which is connected between the coil and the capacitive load, and the other end is connected to the earth potential, and the current is passed from the load capacity to the capacitive load between the second time point and the third time point and between the fifth time point and the sixth time point.

When the DC power source voltage is at a lower side than the earth potential, a charging voltage of the capacitive load is clamped at a DC power source voltage so as to stop the first resonance at the second time point at which the voltage of the capacitive load begins to fall below the DC power source voltage and the current flowing through the coil at this time point is sustained in the first flywheel operational state, and, at the fifth time point at which the voltage of the capacitive load begins to exceed the earth potential, the voltage of the capacitive load is clamped at the earth potential so as to stop the second resonance, and the current flowing through the coil at this time point is sustained in the second flywheel operational state.

According to the present invention, the reactive power, which is used only to charge/discharge the capacitive load, of the electric power supplied to the capacitive load is regenerated to the power source after it is sustained in the form of the current energy for the coil as described above, and therefore power consumption can be reduced.

Further, according to the present invention, two clamping switches difficult in timing control that have been conventionally used are removed, and the number of components is reduced, and, instead, a function for regenerating the flywheel current to the power source is provided. Therefore, electric-power regenerating efficiency sufficient for practical use can be obtained in spite of the fact that the circuit structure is simple and cheap.

Further, since a serial resonance circuit is formed with a coil and a capacitive load, a moderately transient pulse t rain can be obtained. If it is moderately transient, high-frequency components of a pulse shape decrease, and therefore unnecessary electromagnetic-wave radiation caused by the capacitive load can be reduced.

Additionally, when the time of ¼ of the natural oscillation cycle of the serial resonance circuit made up of the coil and the capacitive load elapses after the start of charging or discharging, automatic clamping is carried out without using any switches. Accordingly, it can be easily followed even if the clamping time of voltage changes at random interrelatedly with a random change in the value of the capacitive load. Accordingly, it is possible to avoid conventional difficulties in control by which the timing of switches must follow the clamping time that changes at random.

DETAILED DESCRIPTION OF THE PREFERRED EMBODIMENTS

Referring to the attached drawings, a detailed description will be hereinafter provided of a circuit for driving a capacitive load according to an embodiment of the present invention.

First, a description will be provided of the basic structure of the driving circuit for the capacitive load and the operational principle of a method for driving the capacitive load according to the present invention.

Figure 14:
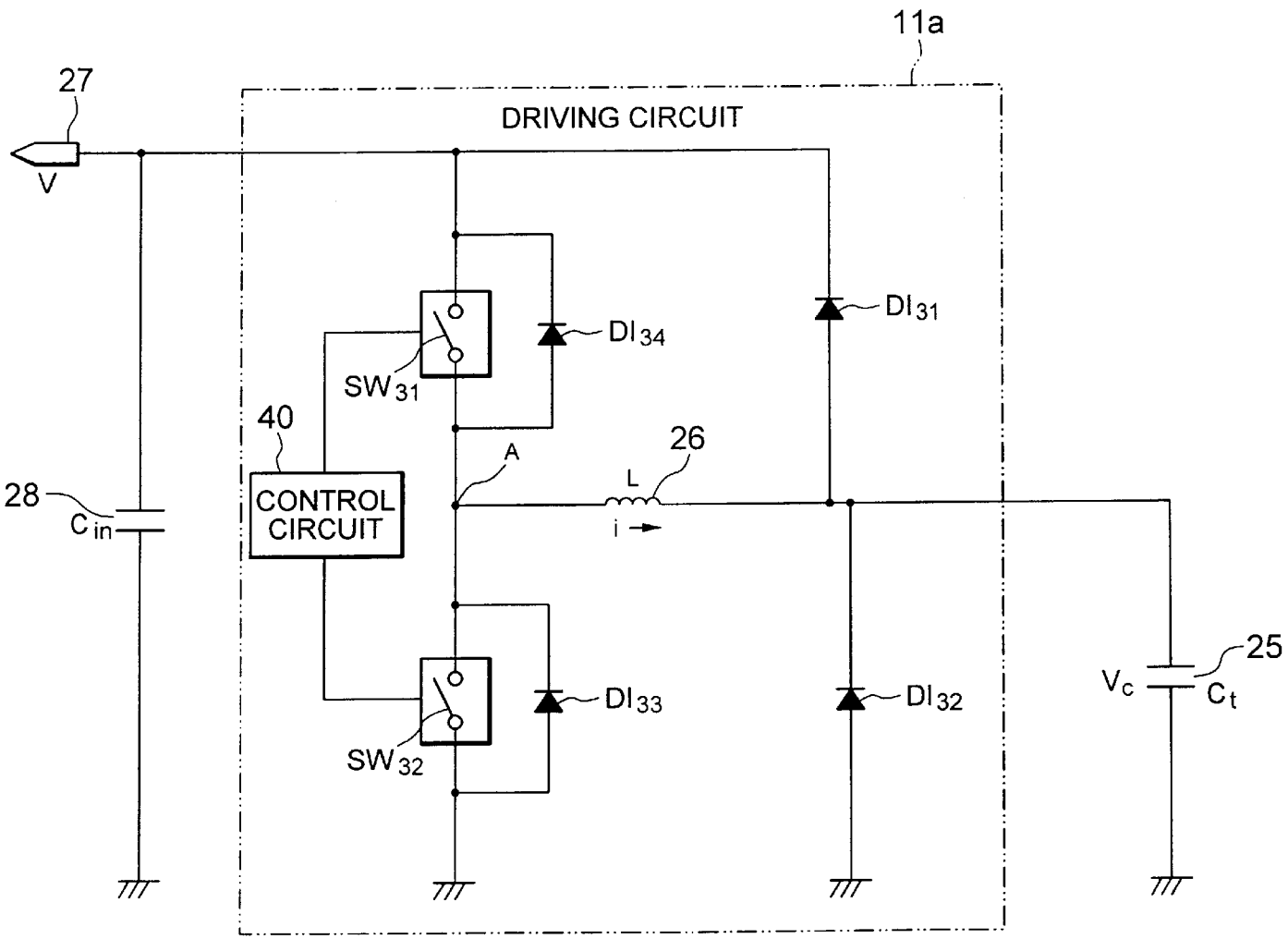
FIG. 14 is a circuit diagram that shows the basic structure of a driving circuit for a capacitive load according to the present invention.
Figure 15:
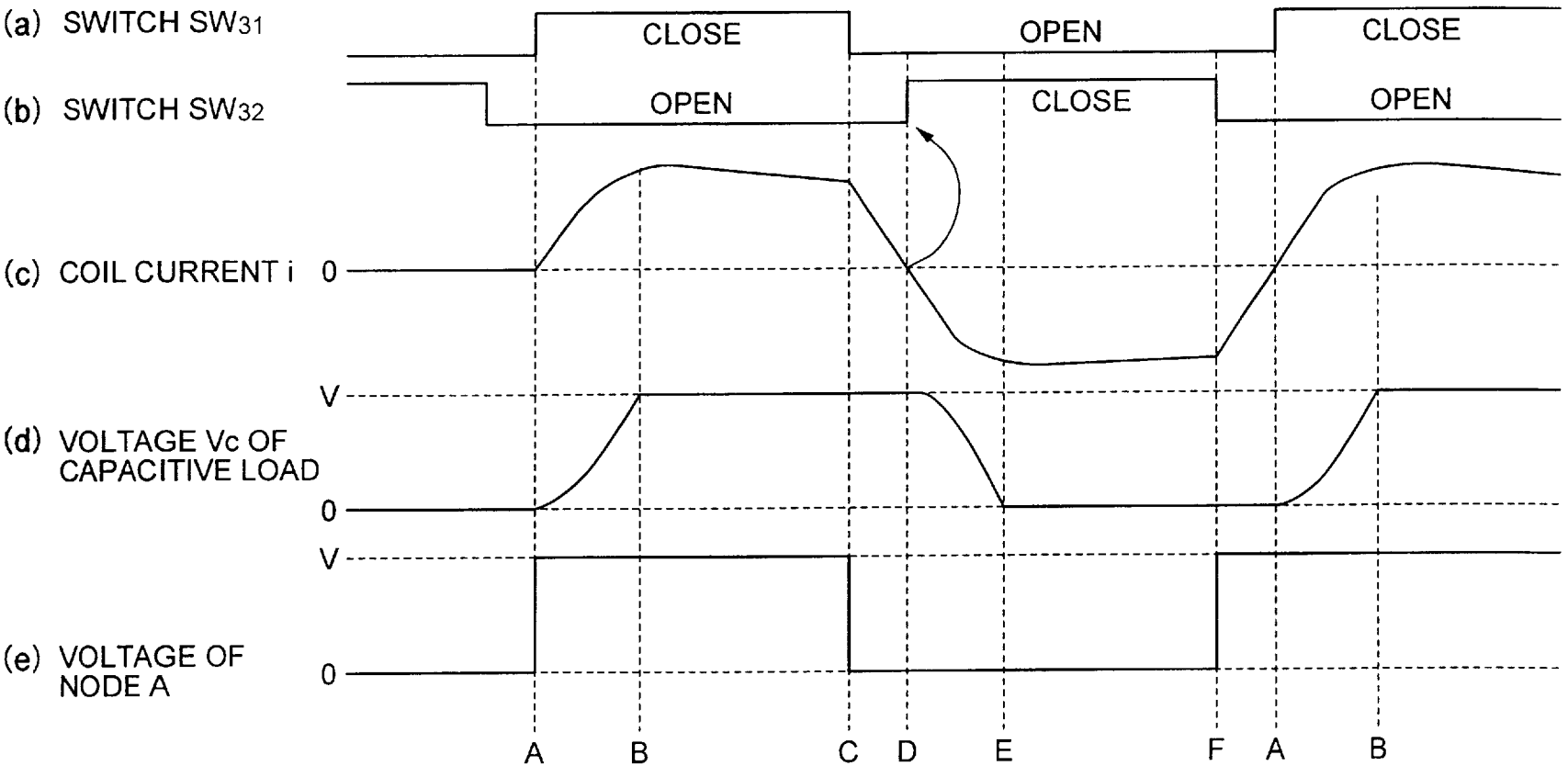
FIG. 15 is a timing chart for explaining the operation of this circuit.

FIG. 14 is a circuit diagram that shows the basic structure of the driving circuit for the capacitive load according to the present invention, and FIG. 15 is a timing chart for explaining the operation of this circuit.

The driving circuit of the present invention differs greatly from the first and second prior art circuits in that the present invention removes two switches conventionally used for clamping and, instead, provides a flywheel current sustaining function that has not been conventionally used, without providing other components and increasing the number of components, and regenerates the flywheel current sustained by this function into a power source.

Herein, the flywheel current sustaining function is defined as the act of sustaining or maintaining energy saved in a coil in such a way that an electric current flowing through the coil at that moment when a resonant state of a serial resonance circuit that comprises a capacitive load and the coil is compulsorily stopped by a clamping means is sustained even after the resonance is stopped (i.e., a flywheel working state is created in which an electric current circulates around a closed-loop).

In order to embody the function, the driving circuit 11*a* of the present invention is constructed as shown in FIG. 14. In detail, a coil 26 is connected in series with a capacitive load 25, such as a row electrode or a column electrode that is an electrode of a plasma display panel or an EL (Electro Luminescence) display panel. The coil 26 and the capacitive load 25 make up a serial resonance circuit. A diode $DI_{31}$ is connected between one end of the coil 26 on the side of the capacitive load 25 and a high-potential power source 27 so that the direction from the coil 26 to the power source 27 is a forward direction, and a diode $DI_{32}$ is connected between the end of the coil 26 and an earth terminal so that the direction from the earth terminal to the coil 26 is a forward direction. Further, a diode $DI_{34}$ is connected between the other end (node A) of the coil 26 and the power source 27 so that the direction from the coil 26 to the power source 27 is a forward direction, and a switch $SW_{31}$ is connected to the diode $DI_{34}$ in parallel. Likewise, a diode $DI_{33}$ is connected between the other end of the coil 26 and the earth terminal so that the direction from the earth terminal to the coil 26 is a forward direction, and a switch $SW_{32}$ is connected to the diode $DI_{33}$ in parallel. And a control circuit 40 that control the operations of the switches $SW_{31}$ and $SW_{32}$ is connected to the switches $SW_{31}$ and $SW_{32}$.

When the switch $SW_{31}$ is closed, a power-supply voltage is applied to the serial resonance circuit made up of the coil 26 and the capacitive load 25 so as to start a resonance in charging, and, when opened, a flywheel current is regenerated into the power source 27. As shown in FIG. 14, when thus charged, a closed-loop of (coil 26)→(diode $DI_{31}$)→(switch $SW_{31}$ in closed state) forms a flywheel current sustaining circuit, and the path of (diode $DI_{33}$)→(coil 26)→(diode $DI_{31}$) connected in series between the earth terminal and the power source 27 forms an electric-current regenerating circuit. The diode $DI_{31}$ interposed between the capacitive load 25 and the power source 27 functions as a clamping means for clamping or fixing the charging voltage of the capacitive load 25 at the power-supply voltage.

On the other hand, when the switch $SW_{32}$ is closed, the voltage of the capacitive load 25 is applied to the serial resonance circuit made up of the capacitive load 25 and the coil 26 so as to start a resonance in discharging, and, when opened, the flywheel current is regenerated into the power source 27. As shown in FIG. 14, when thus discharged, the closed-loop of (coil 26)→(switch $SW_{32}$ in closed state)→(diode $DI_{32}$) forms a flywheel current sustaining circuit, and the path of (diode $DI_{32}$)→(coil 26)→(diode $DI_{34}$) connected in series between the earth terminal and the power source 27 forms an electric-current regenerating circuit. The diode $DI_{32}$ interposed between the earth terminal and the capacitive load 25 functions as a clamping means for clamping or fixing the voltage of the capacitive load 25 at the earth potential.

It is noted that a power source smoothing condenser 28 shown in FIG. 14 has a sufficiently larger electrostatic capacity $C_{in}$ than the electrostatic capacity $C_t$ of the capacitive load 25 so that the voltage does not fluctuate because of the regenerating of the current flowing through the coil 26.

Next, the operational principle of the present invention will be described with reference to FIG. 14 and FIG. 15.

On the assumption that the voltage of the capacitive load 25 is 0[V], and the electric current flowing through the coil 26 is also 0[A], and both the switches $SW_{31}$ and $SW_{32}$ are in an open state (State 0), the stage proceeds from State 0 to State A at time "A".

(1) State A

When the switch $SW_{31}$ is closed (switch $SW_{31}$ of (a) of FIG. 15) at time "A" by the control circuit 40, a power-supply voltage V is applied to a serial resonance circuit (node "A") made up of the coil 26 and the capacitive load 25 (voltage of node "A" of (e) of FIG. 15), and the capacitive load 25 begins to be charged.

The resonance equation of this charging circuit is given by Equation (2). The natural oscillation frequency f0 of the circuit is obtained from Equation (2) (Equation (3)). If initial conditions are applied to Equation (2), the electric current i flowing through the coil 26 at time t is given by Equation (4), and the voltage $V_c$ of the capacitive load 25 at time t is given by Equation (5). In these equations, L is the inductance of the coil 26, and Ct is the electrostatic capacity of the capacitive load 25.

$$L\frac{di}{dt} + \frac{1}{C_{out}}\int i\,dt = V \tag{2}$$

$$f_0 = \frac{1}{2\pi\sqrt{LC_{out}}} \tag{3}$$

$$i = \sqrt{\frac{C}{L}} \times V\sin\frac{1}{\sqrt{LC}}t \tag{4}$$

$$V_c = V\left(1 - \cos\frac{1}{\sqrt{LC}}t\right) \tag{5}$$

Therefore, the electric current i flowing through the coil 26 begins to oscillate at the natural oscillation frequency f0, and rises according to Equation (4) (coil current i of (c) of FIG. 15). On the other hand, the voltage $V_c$ of the capacitive load 25 also begins to oscillate at the natural oscillation frequency f0, and rises toward a value that is twice the power-supply voltage V according to Equation (5) (voltage $V_c$ of the capacitive load of (d) of FIG. 15).

(2) State B

As shown in FIG. 14, when the voltage $V_c$ of the capacitive load 25 exceeds the power-supply voltage V at time B, the diode $DI_{31}$ conducts a current, and therefore the voltage $V_c$ of the capacitive load 25 is clamped at the power-supply voltage V (voltage $V_c$ of the capacitive load of (d) of FIG. 15). As a result, the resonance stops at time B. As can be drawn out from Equation (5), time B is the moment when the time of a quarter of the natural oscillation cycle elapses from time "A". As can be drawn out from Equation (4), an electric current i that flows through the coil 26 at time B is the maximum electric current in resonating (coil current i of (c) of FIG. 15). With time B as a starting point, this current circulates through the closed loop (i.e., flywheel current sustaining circuit) of (coil 26)→(diode $DI_{31}$)→(switch $SW_{31}$ in closed state), and continues the flywheel operation. The electric current of the flywheel operational state is hereinafter designated as the flywheel current, if necessary.

(3) State C

When the switch $SW_{31}$ is opened at time C (switch $SW_{31}$ of (a) of FIG. 15), the flywheel current i has the loop shut off. Accordingly, in order to sustain the current, the voltage at point "A" falls sharply, and further falls below the earth potential so as to allow the diode $DI_{33}$ to conduct a current. Thereby, the flywheel current i is regenerated into the power source 27 through the path of (diode $DI_{33}$)→(coil 26)→(diode $DI_{31}$) shown in FIG. 14, and the current energy saved in the coil 26 is returned to the power source 27. The flywheel current i flowing through the coil 26 decreases interrelatedly with the regenerating (coil current of (c) of FIG. 15). The inclination of the electric current at this time is represented as −V/L [A/second].

(4) State D

When the switch $SW_{32}$ is closed at time D when the current i flowing through the coil 26 reaches zero (switch $SW_{32}$ of (b) of FIG. 15), the voltage $V_c$ saved in the capacitive load 25 is applied to the serial resonance circuit made up of the coil 26 and the capacitive load 25, and the capacitive load 25 begins to discharge (voltage $V_c$ of the capacitive load of (d) of FIG. 15).

The resonance equation of this discharge circuit is given by Equation (6). The natural oscillation frequency f0 of the circuit is drawn out from Equation (6) (Equation (3)). If initial conditions are applied to Equation (6), the current i flowing through the coil 26 at time t is given by Equation (7), and the voltage $V_c$ of the capacitive load 25 at time t is given by Equation (8).

$$L\frac{di}{dt}+\frac{1}{C_{out}}\int i\,dt=0 \tag{6}$$

$$i=-\sqrt{\frac{C}{L}}\times V\sin\frac{1}{\sqrt{LC}}t \tag{7}$$

$$V_c=V\cos\frac{1}{\sqrt{LC}}t \tag{8}$$

The current i flowing through the coil 26 begins to oscillate at natural oscillation frequency f0, and falls according to Equation (7) (coil current of (c) of FIG. 15). On the other hand, the voltage $V_c$ of the capacitive load 25 also begins to oscillate at natural oscillation frequency f0, and falls toward the negative value −V of the power-supply voltage V according to Equation (8) (voltage $V_c$ of the capacitive load of (d) of FIG. 15).

It does not matter if the time when the switch $SW_{32}$ is closed is earlier than time D. However, in order to prevent the power source 27 from being shorted, it is not possible to make it earlier than time C.

(5) State E

Since the diode $DI_{32}$ shown in FIG. 14 conducts a current when the voltage $V_c$ of the capacitive load 25 falls below the earth potential, the voltage $V_c$ of the capacitive load 25 is clamped at the earth potential (voltage $V_c$ of the capacitive load of (d) of FIG. 15). As a result, the resonance stops at time E. As can be drawn out from Equation (8), time E is the moment when the time of a quarter of the natural oscillation cycle elapses from time D. As can be drawn out from Equation (7), an electric current i that flows through the coil 26 at time E is the negative maximum electric current in resonating (coil current i of (c) of FIG. 15). With time E as a starting point, this current circulates through the closed loop (i.e., flywheel current sustaining circuit) of (coil 26)→(switch $SW_{32}$ in closed state)→(diode $DI_{32}$) shown in FIG. 14, and continues the flywheel operation.

(6) State F

When the switch $SW_{32}$ is opened at time F (switch $SW_{32}$ of (b) of FIG. 15), the flywheel current has the loop shut off. Accordingly, in order to sustain the current, the voltage at point "A" rises sharply, and further rises above the power-supply voltage so as to allow the diode $DI_{34}$ to conduct a current.

Thereby, the flywheel current i is regenerated into the power source 27 through the path of (diode $DI_{32}$)→(coil 26)→(diode $DI_{34}$) shown in FIG. 14, and the current energy saved in the coil 26 is returned to the power source 27. The flywheel current i flowing through the coil 26 decreases interrelatedly with the regenerating (coil current of (c) of FIG. 15). The inclination of the electric current at this time is represented as V/L [A/second].

A voltage pulse train is supplied to the capacitive load 25 while repeating the above-mentioned operations. The reactive power used only to charge and discharge the capacitive load 25 is sustained in the form of the current energy of the coil 26, as described above, and thereafter is regenerated into the power source 27. Therefore, power consumption can be reduced.

Additionally, the present invention removes two clamping switches that have difficult timing control that have be en conventionally used, and reduces the number of components, and, instead, provides a function for regenerating the flywheel current to the power source, as described above. Therefore, electric-power regenerating efficiency sufficient for practical use can be obtained in spite of the fact that the circuit structure is simple and cheap.

Further, since a serial resonance circuit is formed with the coil 26 and the capacitive load 25, a moderately transient pulse train can be obtained. If it is moderately transient, the high frequency components of a pulse shape decrease, and therefore unnecessary electromagnetic-wave radiation caused by the capacitive load can be reduced.

Additionally, when the time of ¼ of the natural oscillation cycle of a serial resonance circuit made up of a coil and a capacitive load elapses after the start of charging or discharging, automatic clamping is carried out without using any switches. Accordingly, it can be easily followed even if the clamping time of voltage changes at random interrelatedly with a random change in the value of the capacitive load. In other words, it is possible to avoid conventional difficulties in control by which the timing of switches must follow the clamping time that changes at random.

As a practical matter, the value of the capacitive load rapidly changes at random if this kind of driving device is applied to a driving device for data (row) electrodes. The reason is that a driving element that comprises a switching device column is interposed between the coil 26 and the capacitive load 25, and the number of data electrodes selected by this driving element changes according to input indicative data.

Next, as a first embodiment of the present invention, a description will be provided of an example in which the present invention is applied to a data electrode driving circuit of the three-electrode surface discharge type plasma display panel.

Figure 16:
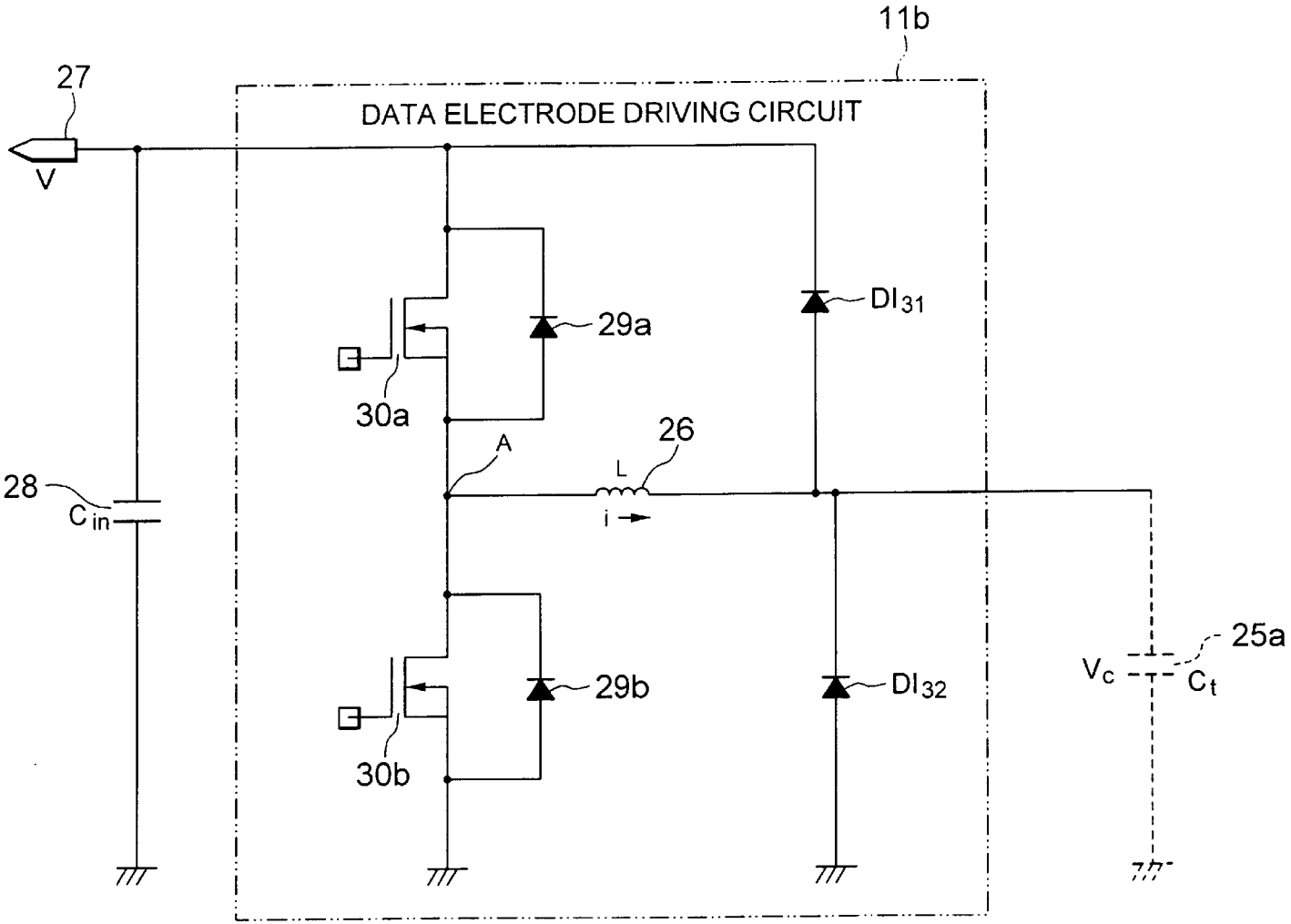
FIG. 16 is a circuit diagram that shows the circuit structure of a data electrode driving circuit according to a first embodiment of the present invention.
Figure 17:
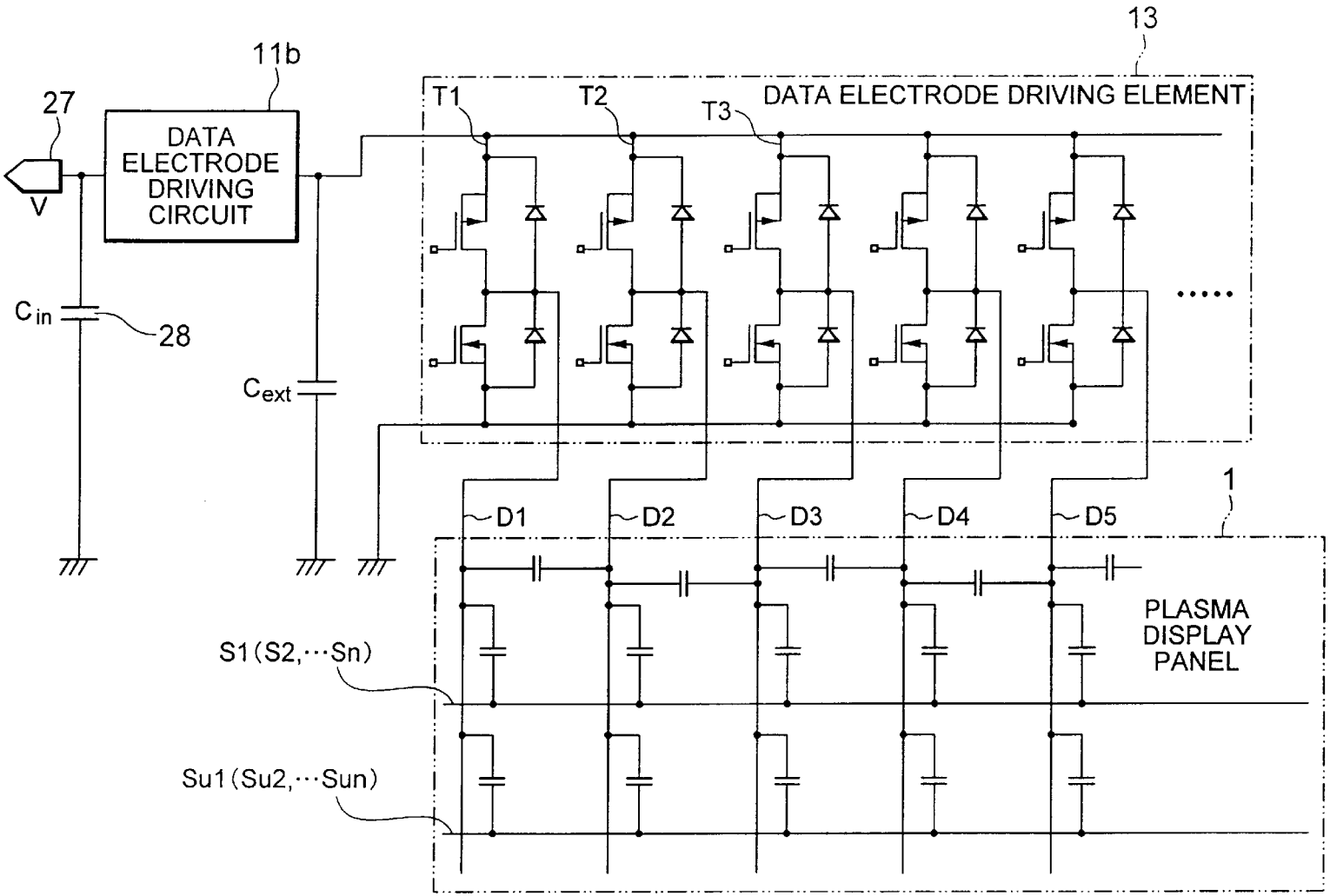
FIG. 17 is a circuit diagram that shows the main part of the circuit structure of a plasma display device provided with this data electrode driving circuit.
Figure 18:
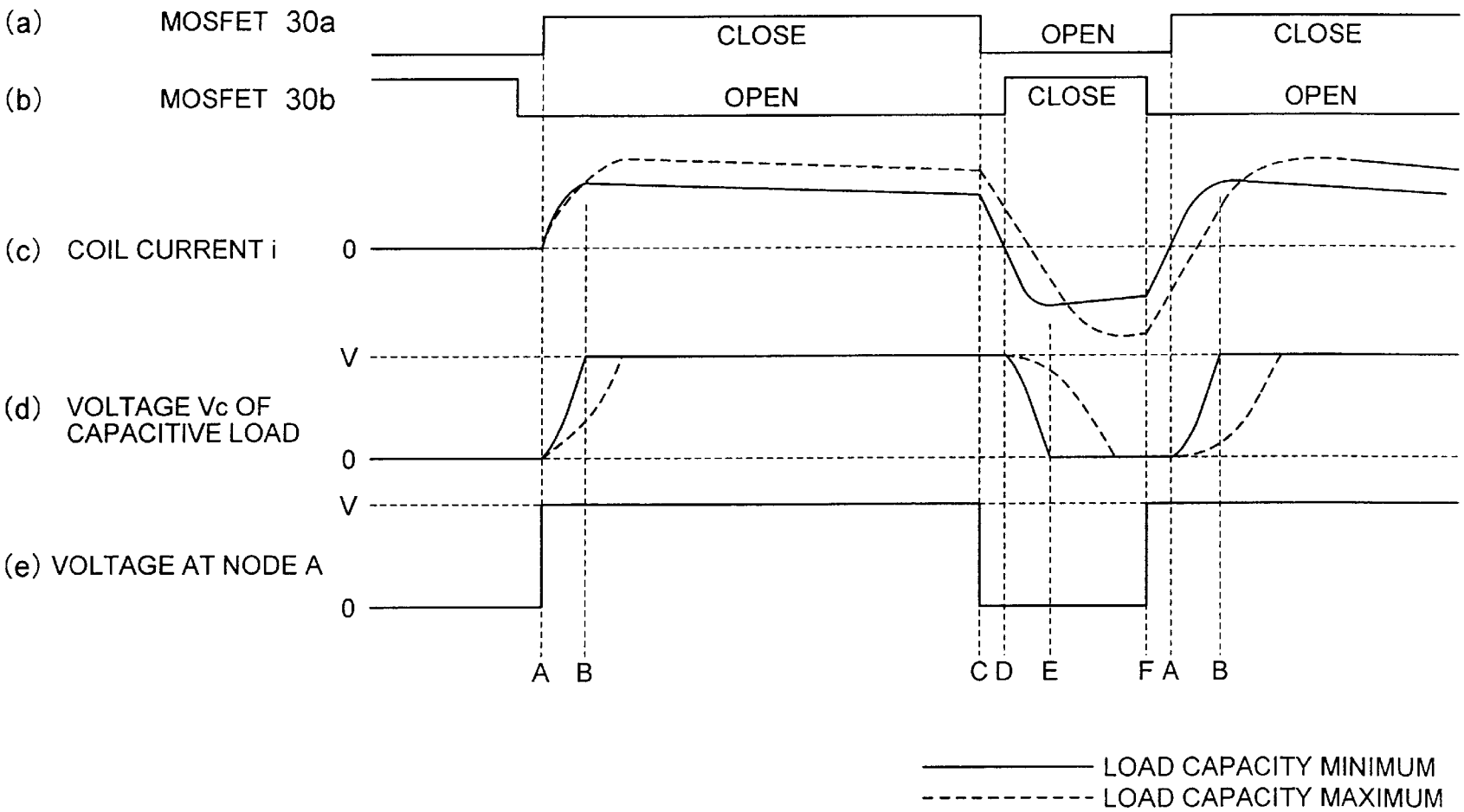
FIG. 18 is a timing chart for explaining the operation of this driving circuit.

FIG. 16 is a circuit diagram that shows the circuit structure of a data electrode driving circuit according to the first embodiment of the present invention, FIG. 17 is a circuit diagram that shows the main part of the circuit structure of a plasma display device provided with this data electrode driving circuit, and FIG. 18 is a timing chart for explaining the operation of this driving circuit.

Figure 1:
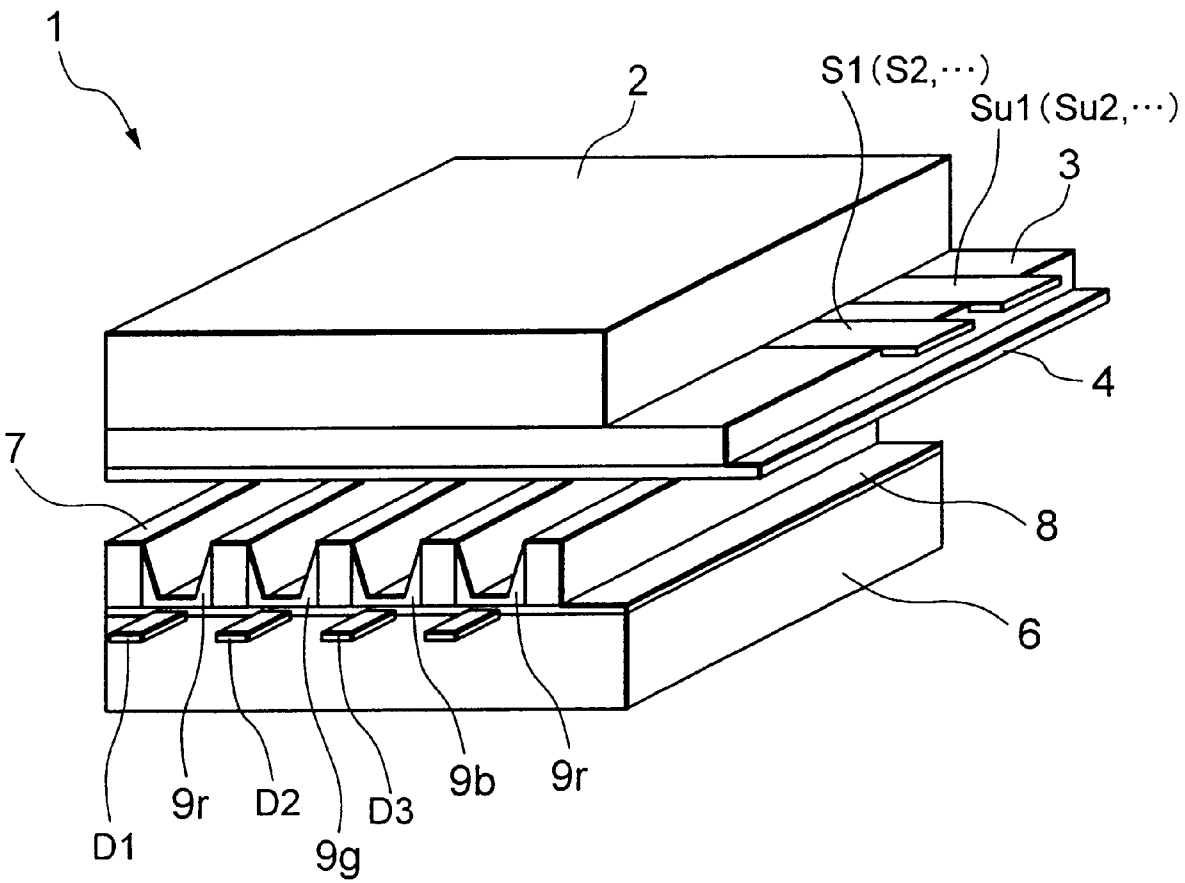
FIG. 1 (PRIOR ART)
FIG. 1 is an exploded perspective view that separately shows the structure of a plasma display panel of the three-electrode surface discharge type.
Figure 2:
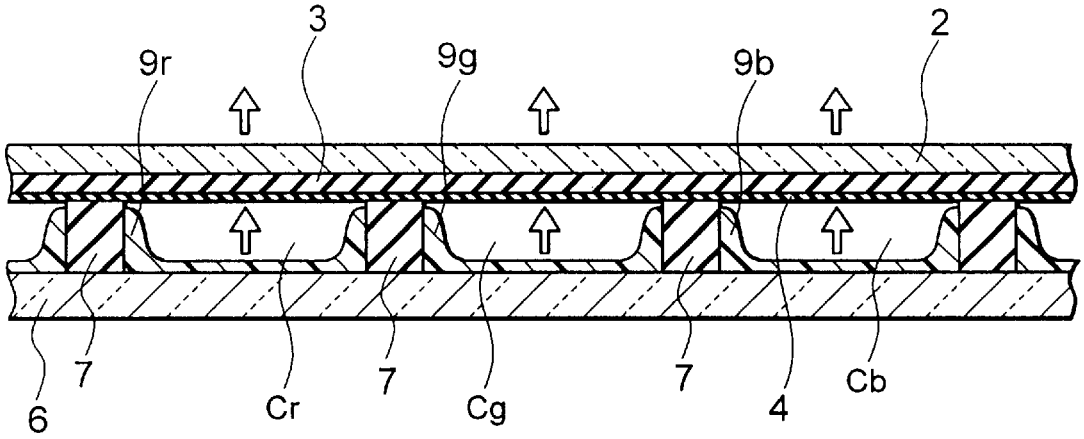
FIG. 2 (PRIOR ART)
FIG. 2 is a cross-sectional view of the plasma display panel of FIG. 1.
Figure 3:
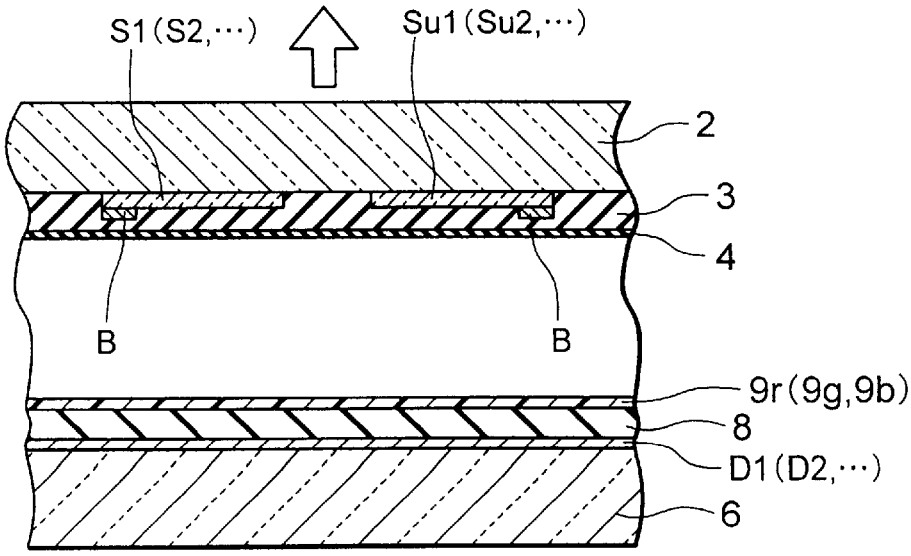
FIG. 3 (PRIOR ART)
FIG. 3 is an enlarged sectional view that shows a part of the further enlarged panel.
Figure 4:
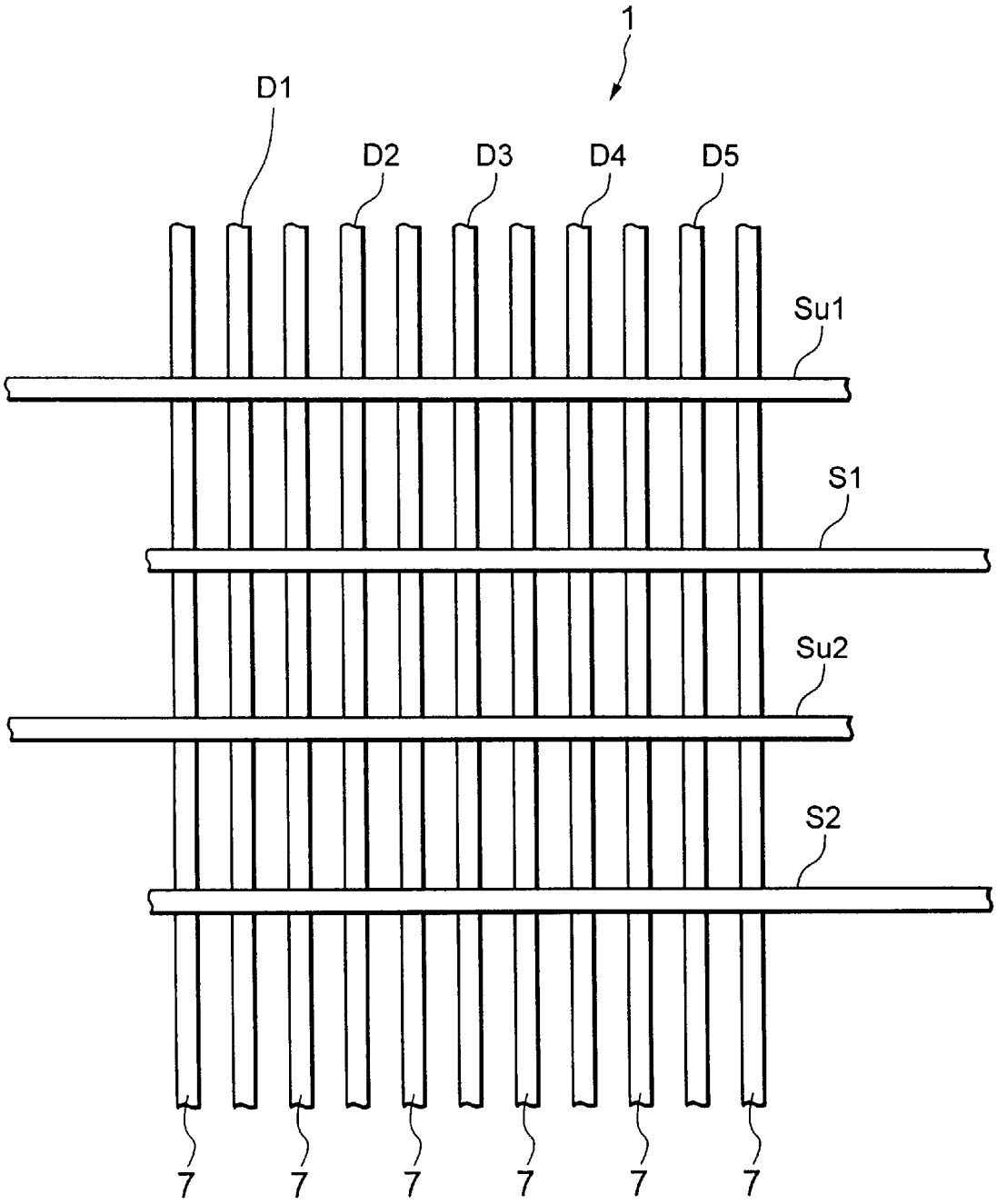
FIG. 4 (PRIOR ART)
FIG. 4 is a plan view that shows an electrode structure shown in FIG. 3.
Figure 5:
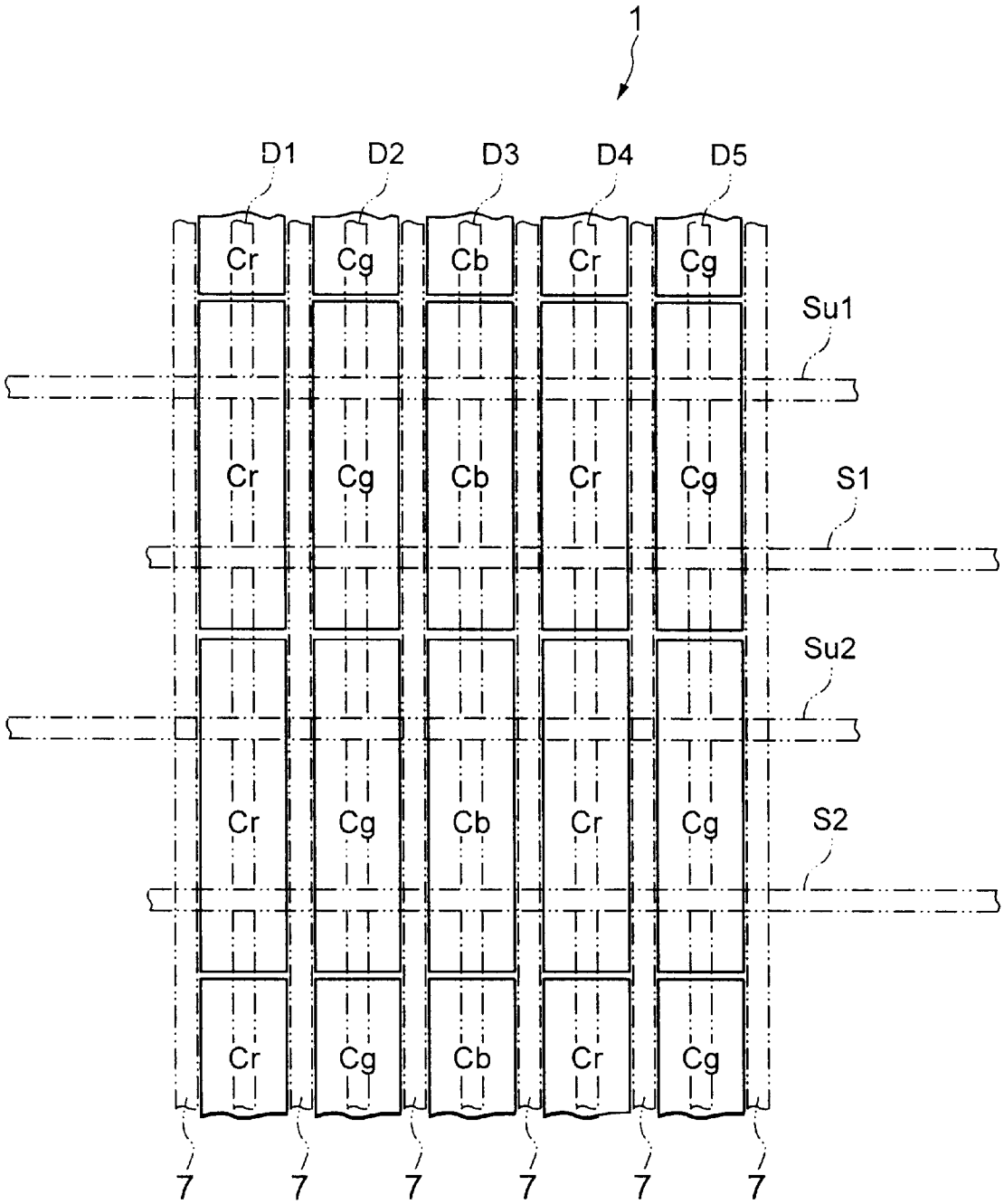
FIG. 5 (PRIOR ART)
FIG. 5 is a plan view that shows the display cell structure of the plasma display panel of FIG. 3.
Figure 6:
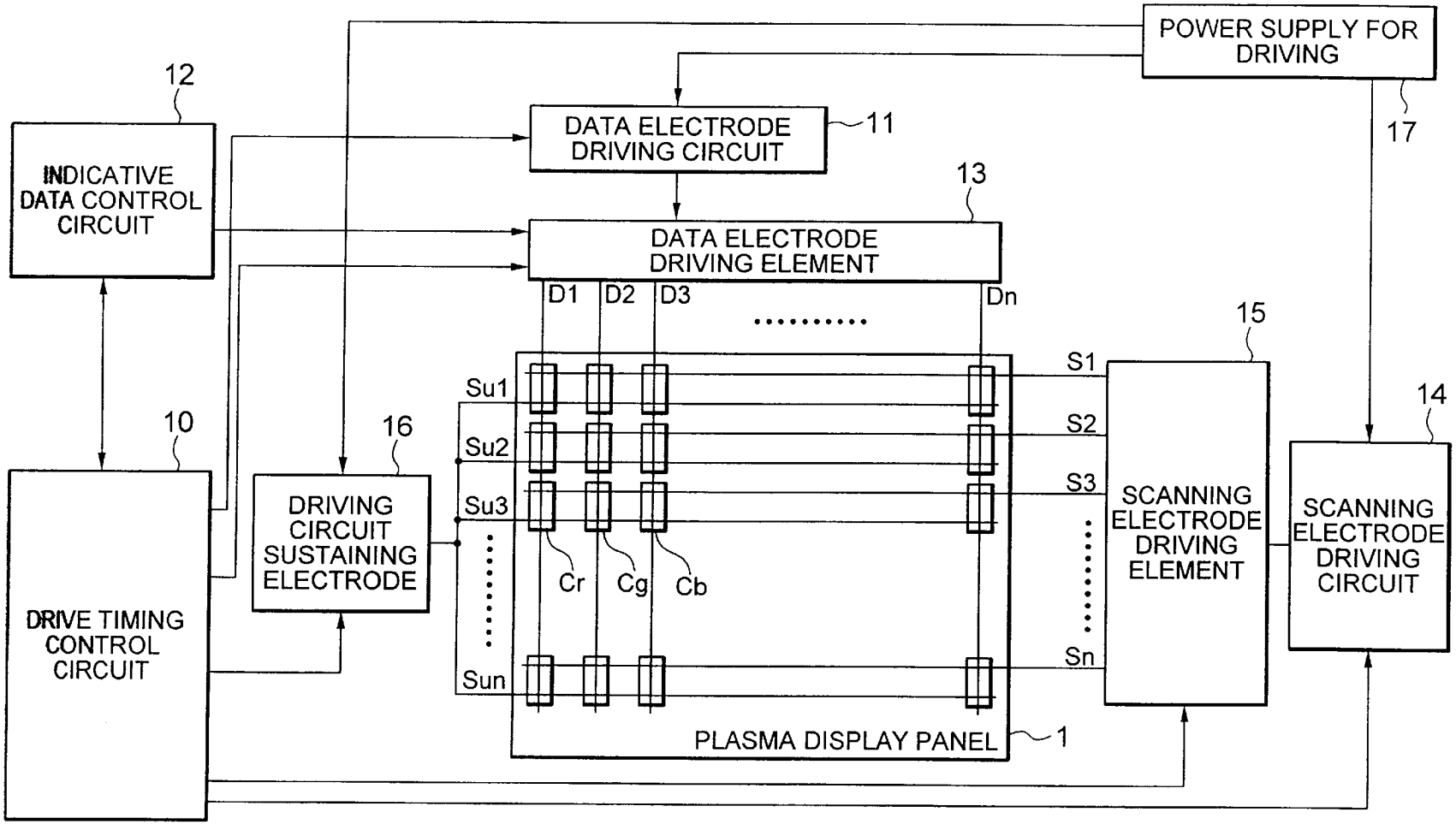
FIG. 6 (PRIOR ART)
FIG. 6 is a block diagram that shows the circuit structure of an AC drive plasma display panel of the three-electrode surface discharge type, especially the circuit structure of a driving circuit portion.
Figure 7:
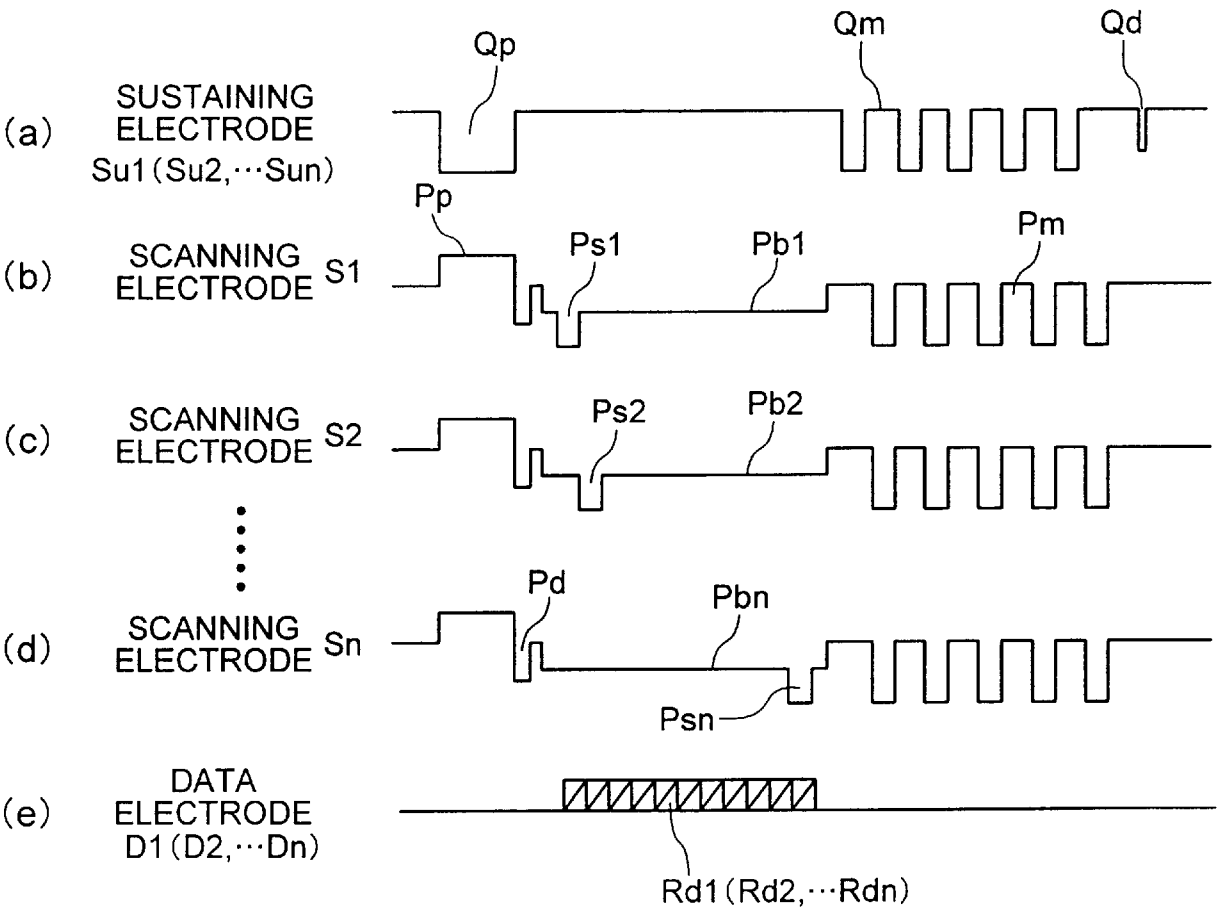
FIG. 7 (PRIOR ART)
FIG. 7 shows various driving waveforms in one subfield.
Figure 8:
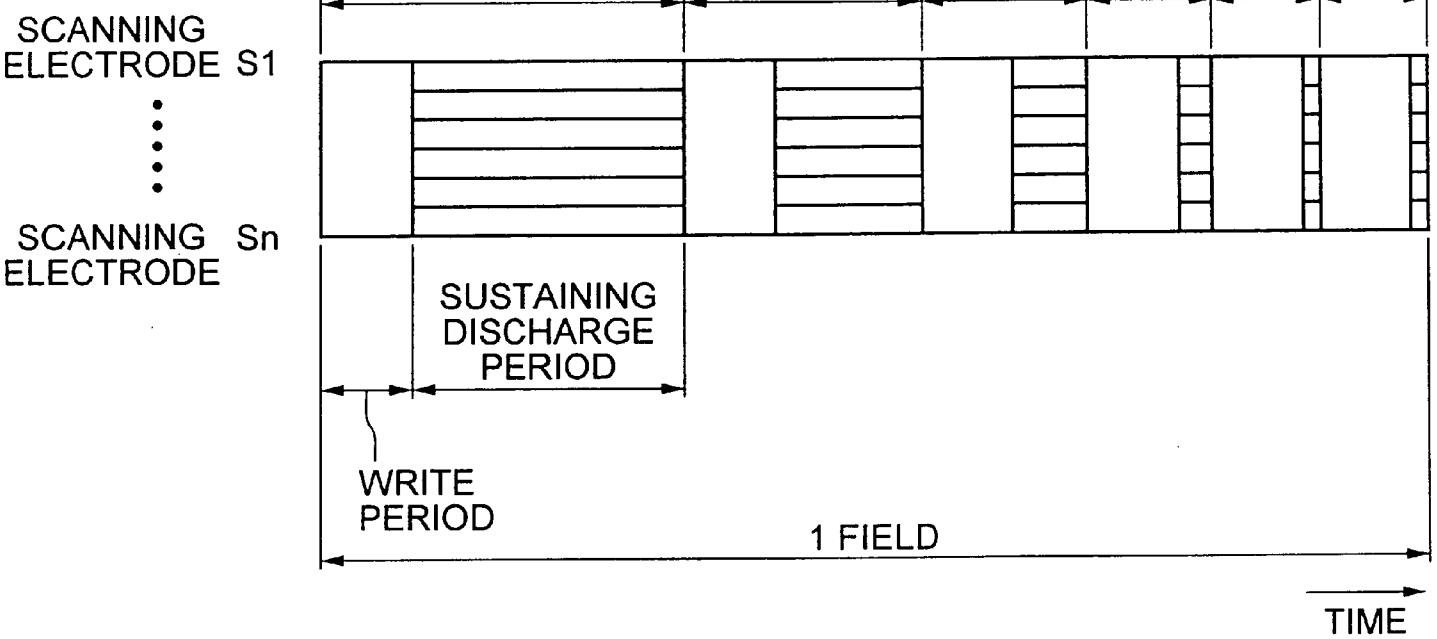
FIG. 8 (PRIOR ART)
FIG. 8 is an explanatory drawing for explaining a driving sequence under the subfield method.
Figure 9:
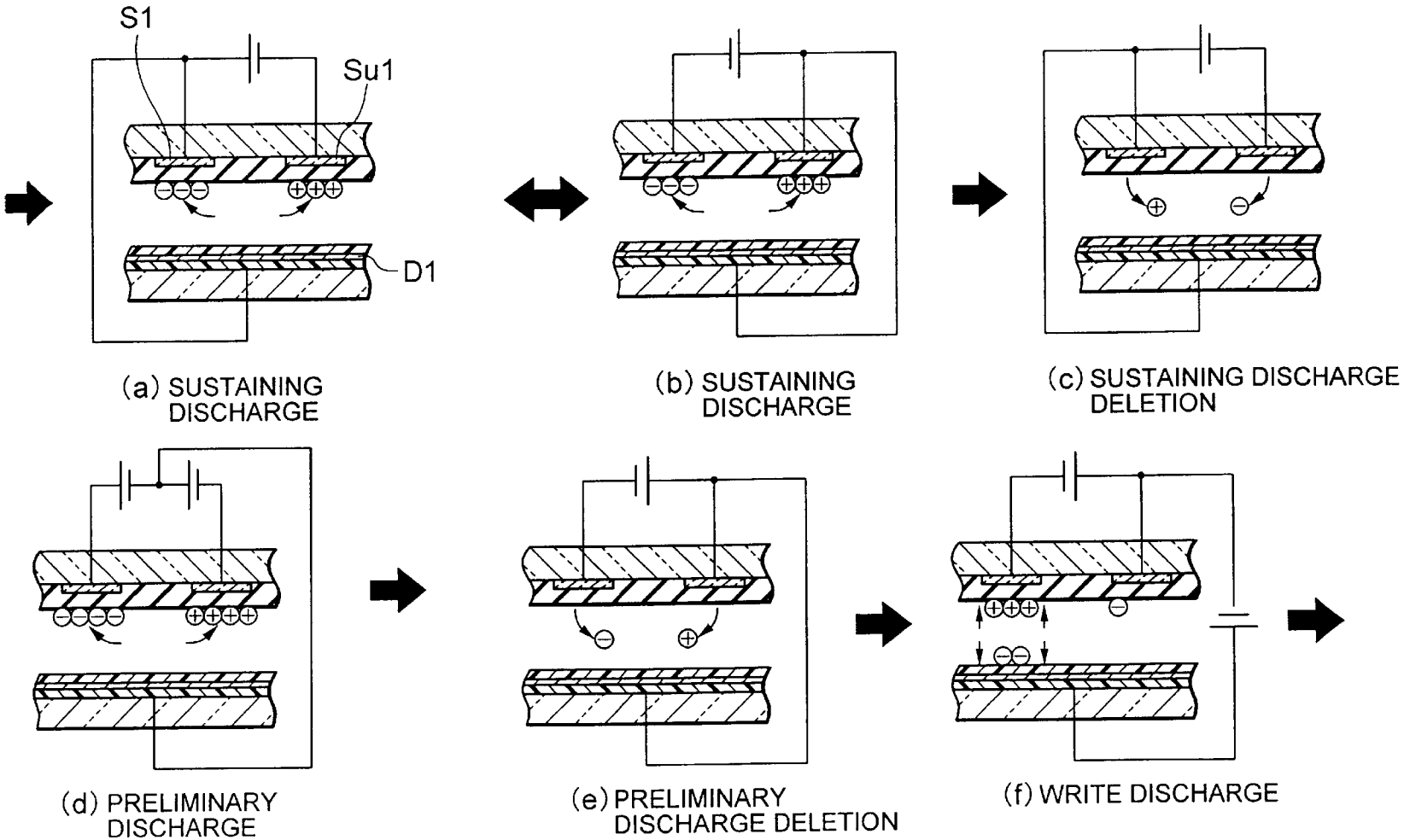
FIG. 9 (PRIOR ART)
FIG. 9 is an explanatory drawing for explaining the subfield operation of the three-electrode surface discharge type plasma display device.
Figure 10:
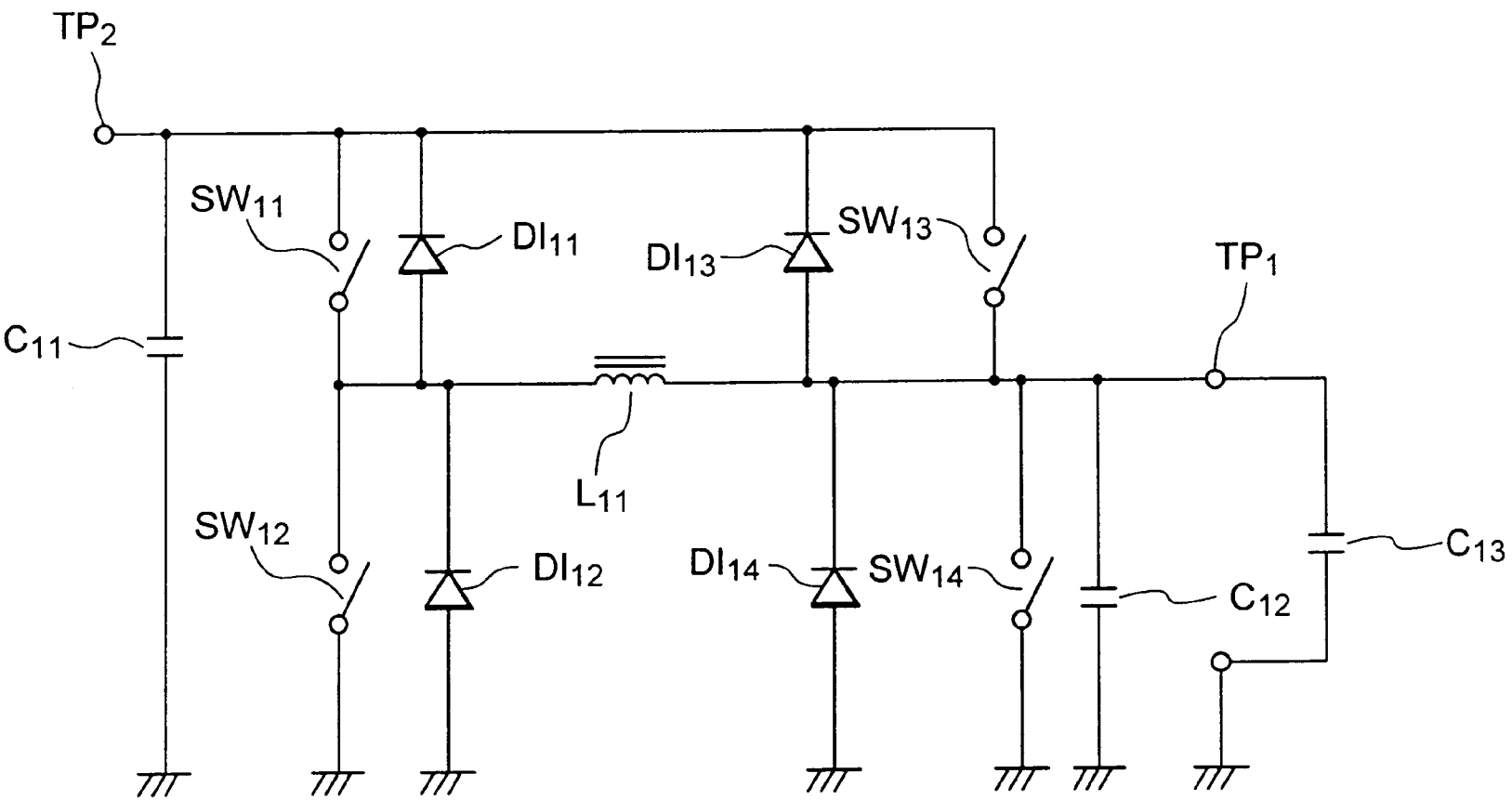
FIG. 10 (PRIOR ART)
FIG. 10 is a circuit diagram that shows the basic structure of a sustaining pulse generation circuit provided with an electric-power regenerating function according to the first prior art.
Figure 11:
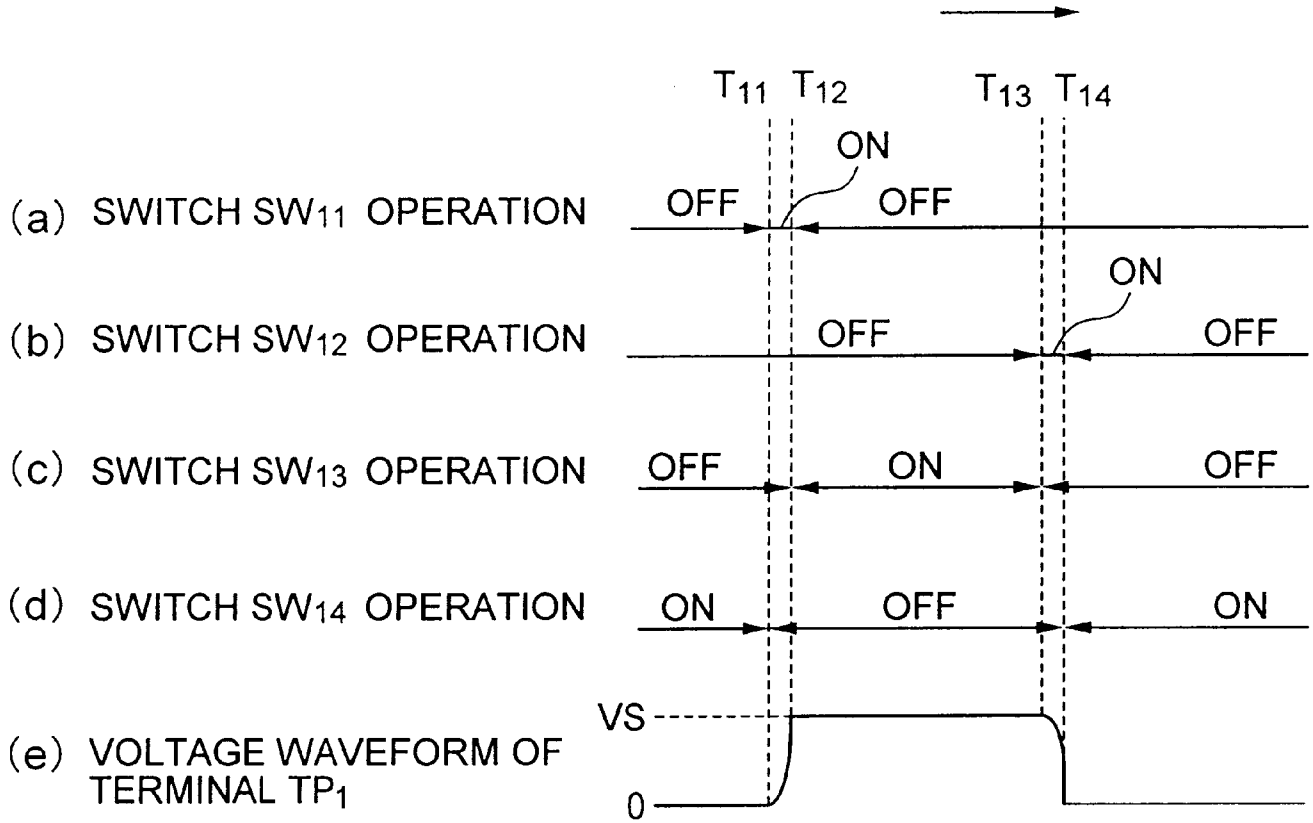
FIG. 11 (PRIOR ART)
FIG. 11 is a timing chart for explaining the operation of the circuit shown in FIG. 10.
Figure 12:
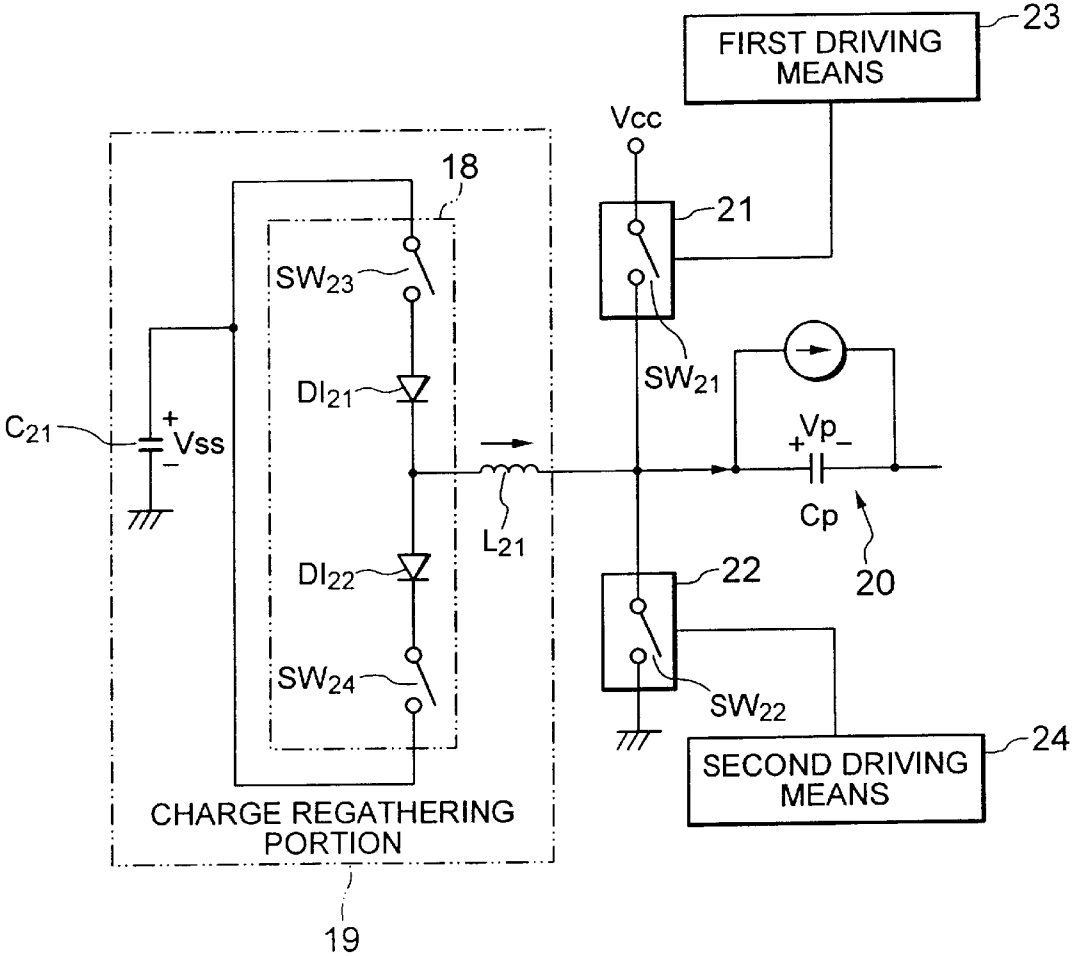
FIG. 12 (PRIOR ART)
FIG. 12 is a circuit diagram that shows the basic structure of a sustaining pulse generation circuit provided with an electric-power regenerating function according to the second prior art.
Figure 13:
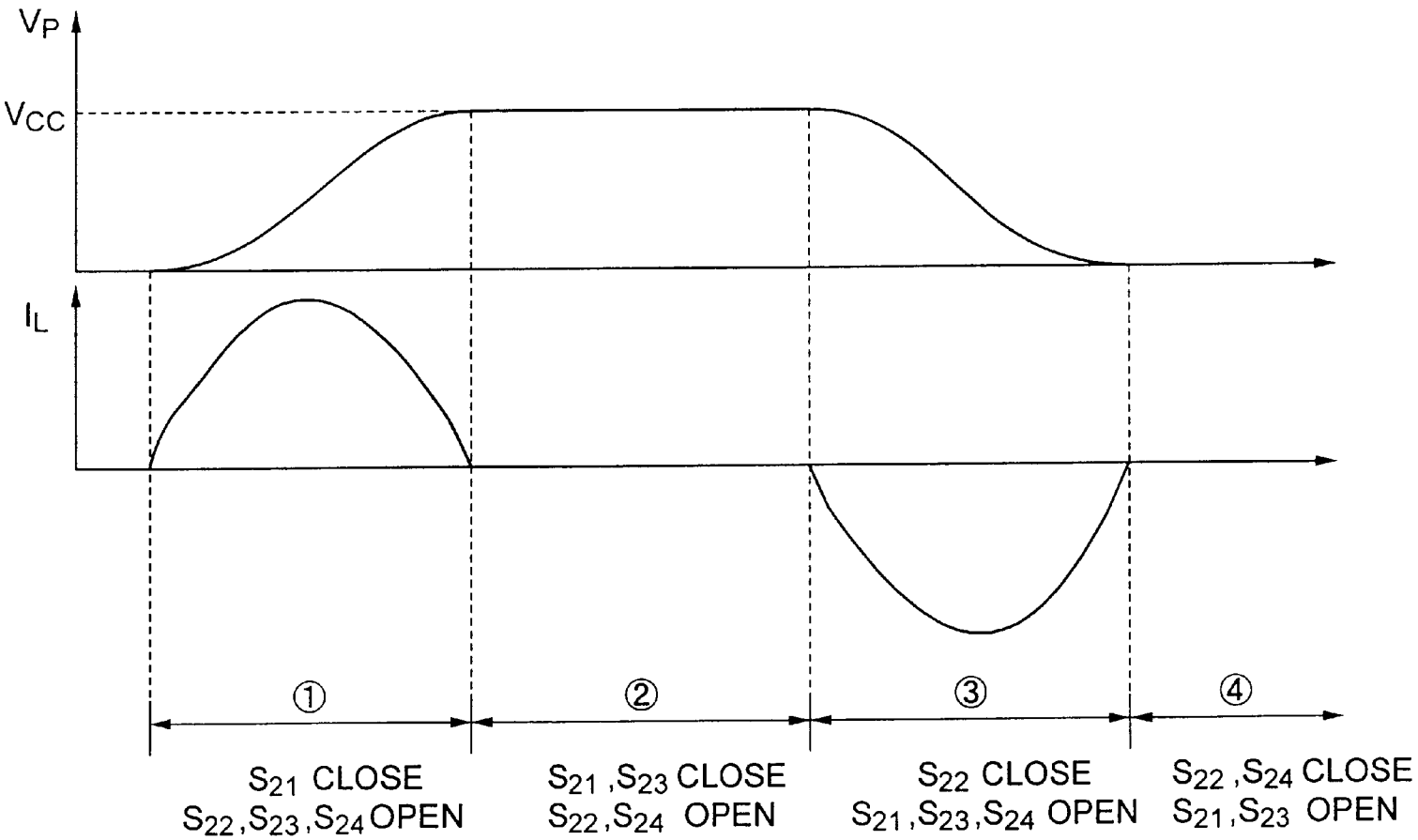
FIG. 13 (PRIOR ART)
FIG. 13 shows waveforms of an electric current by an output voltage and an electromotive force of a coil for explaining the operation of the circuit shown in FIG. 12.

In FIG. 16, the same reference characters are given to the constituent elements, respectively, that have the same functions as the constituent elements in FIG. 14, and a detailed description thereof is omitted. Likewise, in FIG. 17, the same reference characters are given to the constituent elements, respectively, that have the same functions as the constituent elements in FIG. 6, and a detailed description thereof is omitted. Further, in FIG. 17, the scanning electrode driving circuit 14, the scanning electrode driving element 15, and the sustaining electrode driving circuit 16 as shown in FIG. 6 are omitted because they are unnecessary for describing this embodiment.

A data electrode driving circuit 11*b* of this embodiment is an actual circuit to embody the basic circuit of FIG. 14. A parallel connection part of the switch $SW_3$ and the diode $DI_{31}$ shown in FIG. 14 and a parallel connection part of the switch $SW_{32}$ and the diode $DI_{32}$ shown in FIG. 14 are constructed with, as shown in FIG. 16, switching elements of the n-type MOSFET that include parasitic diodes 29*a* and 29*b*, respectively (hereinafter designated as MOS power MOSFET switch 30*a* or 30*b*). In a plasma display device where this driving circuit 11*b* is built in, the coil 26 and the data electrode D (D1, D2, . . . ) make up a serial resonance circuit through the data electrode driving element 13, as shown in FIGS. 16 and 17.

When the sustaining electrodes Su (Su1, Su2, . . . ) are driven, all the sustaining electrodes Su are driven with the same timing. That is, since the whole area of the panel 1 is driven by the same pulse during the sustaining discharge, what is necessary is to add one power source recovery circuit. However, batch driving cannot be performed because the data (row) electrodes D1, D2, . . . are driven in correspondence with an image to be displayed. Therefore, a data electrode driving circuit llb serving as a driving-pulse supply means is disposed outside, and the data electrode driving circuit 11*b* is provided with a power source regenerating function. In addition, a data electrode- driving element 13 for determining whether a driving pulse is transmitted to each data electrode D or not is disposed between the data electrode driving circuit 11*b* and each data electrode D on the panel 1. As shown in FIG. 17, the data electrode driving element 13 comprises a high-pressure resistance switching element group T1, T2, . . . of the C-MOS structure that are connected to the data electrodes D by one-to-one. The indicative data control circuit 12 (see FIG. 6) outputs lighting-indicative data about n data electrodes to the high-pressure resistance switching element group T1, T2, . . . synchronously with the driving timing of each data electrode D controlled by the drive timing control circuit 10. Based on the lighting indicative data, the high-pressure resistance switching element group T1, T2, . . . supplies the driving pulse generated by the data electrode driving circuit 11*b* only to the data electrodes D selected (i.e., allowed to receive a write selection) so as to perform the sustaining discharge for the subsequent sustaining discharge period. At this time, the high-pressure resistance switching element group T1, T2, . . . simultaneously supplies the driving pulse to all of the selected data electrodes D.

The data electrode driving circuit 11*b* is designed to continue transmitting a pulse train to the data electrode driving element 13 even if the write selection of the data electrodes D is not made at all when write scanning is carried out. A high-speed transient is generated in this situation because a load capacity reaches the minimum. As a result, unnecessary electromagnetic waves are radiated. Accordingly, in this embodiment, a condenser $C_{ext}$ is connected between the output side of the data electrode driving circuit 11*b* and the earth terminal side thereof, in order to ease the transient and prevent unnecessary electromagnetic waves from occurring even in this situation. The condenser $C_{ext}$ may be omitted in an environment in which the radiation of unnecessary electromagnetic waves does not cause any critical problems.

The data electrode D on the plasma display panel 1 has a capacity component called "opposed capacity" between the data electrode and a row electrode that comprises scanning electrodes S and sustaining electrodes Su perpendicular to the data electrode. Further, if there is a non-select data electrode adjacent to the data electrode allowed to make a write select ion during a scanning period, the non-select electrode is fixed at the earth potential. As a result, a data inter-electrode capacity is generated between the selected data electrode and the non-select data electrode. The total capacity including the transient-easing condenser $C_{ext}$ in addition to the opposed capacity and the data inter-electrode capacity corresponds to the capacitive load 25*a* connected to the data electrode driving circuit 11*b* of this example. The capacitive load 25*a* changes according to the indicative data that is input per line-sequential scanning.

The data electrode-driving element 13 updates the write data only with timing when the voltage $V_c$ of the capacitive load 25*a* is 0V. As mentioned above, the timing of this update is supplied from the drive timing control circuit 10 (see FIG. 6) to the data electrode driving element 13.

The reason why pulses are used for data driving is to carry out the electric-power regenerating operation. However, in order to raise the electric-power regenerating efficiency, there is a need to give a predetermined voltage as long as possible in consideration of fluctuations in characteristics of the electrodes or a change in the load capacity $C_t$ corresponding to the input indicative data. Therefore, the duty ratio is high.

Additionally, if there is a parasitic diode inside the data electrode-driving element 13, it can be used as a diode for clamping and current regenerating. Therefore, it is possible to remove the clamping and current-regenerating diode $DI_{32}$ interposed between the coil 26 and the earth terminal.

Next, the operation of this example will be described with reference to FIG. 16 to FIG. 18.

On the assumption that the voltage of the capacitive load 25*a* is 0[V], and the electric current flowing through the coil 26 is also 0[A], and the MOSFET switches 30*a* and 30*b* are each in an open state (State 0), the stage proceeds from State 0 to State A at time "A".

(1) State A

When the MOSFET switch 30*a* is closed (MOSFET 30*a* of (a) of FIG. 18) at time "A", a power-supply voltage V is applied to a serial resonance circuit (node "A") made up of the coil 26 and the capacitive load 25*a* (voltage of node "A" of (e) of FIG. 18), and the capacitive load 25*a* begins to be charged. The electric current i flowing through the coil 26 begins to oscillate at the natural oscillation frequency f0 of a series resonance system determined by both the inductance L and the load capacity $C_t$, and rises according to Equation (4) (coil current i of (c) of FIG. 18). On the other hand, the voltage $V_c$ of the capacitive load 25*a* also begins to oscillate at the natural oscillation frequency f0, and rises toward a value of twice the power-supply voltage V according to Equation (5) (voltage $V_c$ of the capacitive load of (d) of FIG. 18).

(2) State B

As shown in FIG. 16, when the voltage $V_c$ of the capacitive load 25*a* exceeds the power-supply voltage V at time B, the diode $DI_{31}$ conducts a current, and therefore the voltage $V_c$ of the capacitive load 25*a* is clamped at the power-supply voltage V (voltage $V_c$ of the capacitive load of (d) of FIG. 18). As a result, the resonance stops at time B. As can be drawn out from Equation (5), time B is the moment when a quarter of the natural oscillation cycle time has elapsed from time "A". This natural oscillation cycle is the shortest when the load capacity is minimum, as indicated by the solid line of (d) of FIG. 18, and, therefore, time B (clamping time) comes early. On the other hand, when the load capacity is maximum, the cycle is longest, as indicated by the broken line of (d) of FIG. 18, and, therefore, time B (clamping time) comes late. As can be drawn out from Equation (4), an electric current i that flows through the coil 26 at time B is maximum electric current in resonating (coil current i of (c) of FIG. 18). With time B as a starting point, this current circulates through the closed loop (i.e., flywheel current sustaining circuit) of (coil 26)→(diode $DI_{31}$)→(MOSFET switch 30*a* in closed state), and continues the flywheel operation.

(3) State C

When the MOSFET switch 30*a* is opened at time C (MOSFET 30*a* of (a) of FIG. 15), the flywheel current i has the loop shut off. Accordingly, in order to sustain the current, the voltage at point "A" falls sharply, and further falls below the earth potential so as to allow the parasitic diode 29*b* to conduct a current.

Thereby, the flywheel current i is regenerated into the power source 27 through the path of (parasitic diode 29*b*) →(coil 26)→(diode $DI_{31}$) as shown in FIG. 16, and the current energy saved in the coil 26 is returned to the power source 27. The flywheel current i flowing through the coil 26 decreases interrelatedly with the regenerating (coil current i of (c) of FIG. 18). As a result of the regenerating, time when the current i flowing through the coil 26 reaches zero depends on the natural oscillation cycle or the flywheel current value at time C, and, accordingly, depends on the amount of the load capacity $C_t$. When the load capacity $C_t$ is maximum, it becomes latest, as indicated by the broken line of (c) of FIG. 18. On the other hand, when the load capacity $C_t$ is minimum, it has a tendency to become earliest, as indicated by the solid line of (c) of FIG. 18.

(4) State D

Thereafter, the MOSFET switch 30*b* is closed. In the current regenerating efficiency, a situation in which the timing with which the MOSFET switch 30*b* is closed is earlier, as a whole, than the moment when the current i flowing through the coil 26 reaches zero is better than a situation in which the timing is later than that moment. Therefore, in this example, timing is adjusted so that the MOSFET switch 30*b* is closed at time D when the current i flowing through the coil 26 reaches zero and when the load capacity Ct (including the transient easing condenser $C_{ext}$) is the minimum (solid line of (c) of FIG. 18). In the second embodiment of the present invention, a detailed description will be given of the reason why the current regenerating efficiency is better in the situation in which the timing of the switch is earlier than the aforementioned moment.

When the MOSFET switch 30*b* is closed at time D (MOSFET 30*b* of (b) of FIG. 18), the charging voltage $V_c$ of the capacitive load 25*a* is applied to the serial resonance circuit made up of the coil 26 and the capacitive load 25*a*, and the capacitive load 25*a* begins to discharge (voltage $V_c$ of the capacitive load of (d) of FIG. 18).

The current i flowing through the coil 26 begins to oscillate at natural oscillation frequency f0, and falls according to Equation (7) (coil current of (c) of FIG. 18). On the other hand, the voltage $V_c$ of the capacitive load 25*a* also begins to oscillate at the natural oscillation frequency f0, and falls toward the negative value −V of the power-supply voltage V according to Equation (8) (voltage $V_c$ of the capacitive load of (d) of FIG. 18).

(5) State E

Since the diode $DI_{32}$ conducts a current when the voltage $V_c$ of the capacitive load 25*a* falls below the earth potential, as shown in FIG. 16, the voltage $V_c$ of the capacitive load 25*a* is clamped at the earth potential (voltage $V_c$ of the capacitive load of (d) of FIG. 18). As a result, the resonance stops at time E. As can be drawn out from Equation (8), time E is the moment when a quarter of the natural oscillation cycle time has elapsed from time D. As can be drawn out from Equation (7), an electric current i that flows through the coil 26 at time E is the negative maximum electric current in resonance (coil current i of (c) of FIG. 18). With time E as a starting point, this current circulates through the closed loop (i.e., flywheel current sustaining circuit) of (coil 26)→(MOSFET switch 30*b* in closed state)→(diode $DI_{32}$) shown in FIG. 16, and continues the flywheel operation.

(6) State F

When the MOSFET switch 30*b* is opened at time F (MOSFET 30*b* of (b) of FIG. 18), the flywheel current has the loop shut off. Accordingly, in order to sustain the current, the voltage of node "A" rises sharply, and further rises above the power-supply voltage so as to allow the parasitic diode 29*a* to conduct the current.

Thereby, the flywheel current i is regenerated into the power source 27 through the path of (diode $DI_{32}$)→(coil 26)→(parasitic diode 29*a*) as shown in FIG. 16, and the current energy saved in the coil 26 is returned to the power source 27. The flywheel current i flowing through the coil 26 decreases interrelatedly with the regenerating (coil current of (c) of FIG. 18).

(1) (again) State A

Thereafter, the MOSFET switch 30*a* is closed, so that the stage returns to State "A" again. For the same reason as in the description of "State D", this timing is caused to coincide with the timing (time "A") with which the MOSFET switch 30*a* is closed at the point when the current i flowing through the coil 26 reaches zero and when the load capacity Ct (including the transient easing condenser $C_{ext}$) is the minimum (solid line of (c) of FIG. 18).

A voltage pulse train is supplied to the capacitive load 25*a* while repeating the series of operations as described above. According to the structure of this example, approximately 60% or more reactive power can be reduced under the operating conditions of total load capacity 15 nF, coil inductance 2.7 μH, power-supply voltage 70V, and pulse cycle 2.6 μS.

Especially, when ¼ of the natural oscillation cycle time of the serial resonance circuit made up of the coil and the capacitive load has elapsed, automatic clamping is carried out without using any switches. Accordingly, it can be easily followed even if the clamping time of voltage changes at random interrelatedly with a random change in the value of the capacitive load. Therefore, an advantage can be obtained by always applying this to the driving of data electrodes different in the load capacity according to input indicative data.

Further, since the condenser $C_{ext}$ is interposed between the output side of the coil 26 and the earth terminal side thereof, a transient can be eased even when the load capacity is the minimum, and, therefore, unnecessary electromagnetic waves can be prevented from occurring.

Next, a second embodiment of the present invention will be described hereinafter.

In the first embodiment described above, after the MOSFET switch 30*a* is opened (i.e., past time C), timing with which the MOSFET switch 30*b* is closed is caused to coincide with time D when the current i flowing through the coil 26 reaches zero and when the load capacity $C_t$ is the minimum, as shown in FIG. 18, and, in the same way, after the MOSFET switch 30*b* is opened (past time F), timing with which the MOSFET switch 30*a* is closed is caused to coincide with time "A" when the current i flowing through the coil 26 reaches zero and when the load capacity Ct is the minimum. However, the second embodiment differs from the first embodiment in that timing is adjusted so that the MOSFET switch 30*b* is closed at a time earlier than time D past time C, and, in the same way, timing is adjusted so that the MOSFET switch 30*a* is closed at a time earlier than time "A" past time F.

Accordingly, in this embodiment, the MOSFET switch 30*b* is closed at a time earlier than time D after the MOSFET switch 30*a* is opened at time C of FIG. 18, and, subsequent to this, the flywheel current i is regenerated into the power source 27 not through the path of (parasitic diode 29*b*)→(coil 26)→(diode $DI_{31}$), but through the path of (MOSFET switch 30*b* in closed state)→(coil 26)→(diode $DI_{31}$) shown in FIG. 16. Therefore, a forward-direction loss resulting from the passing of the flywheel current through the parasitic diode 29*b* can be reduced. Likewise, the MOSFET switch 30*a* is closed at time earlier than time "A" after the MOSFET switch 30*b* is opened at time F of FIG. 18, and, subsequent to this, the flywheel current i is regenerated into the power source 27 not through the path of (diode $DI_{32}$)→(coil 26)→(parasitic diode 29*a*), but through the path of (diode $DI_{32}$)→(coil 26)→(MOSFET switch 30*a* in closed state) as shown in FIG. 16. Therefore, a forward-direction loss resulting from the passing of the flywheel current through the parasitic diode 29*a* can be reduced.

Therefore, according to the structure of this embodiment, an even higher current regenerating efficiency than that of the first embodiment can be obtained.

If the timing with which the MOSFET switch 30*b* (30*a*) is closed is brought as near as possible to time C (A) in this structure, the current regenerating efficiency will be correspondingly improved.

Additionally, at node "A" (FIG. 16) of the circuit, a voltage reversal occurs before the MOSFET switch 30*b* (30*a*) is closed at time C (time F) when the MOSFET switch 30*a*(30*b*) is opened, because of the circulation or commutation of the current through the coil 26. For this reason, a switching loss caused when the MOSFET switch 30*b*(30*a*) is closed is greatly reduced. From this viewpoint, it is preferable to shorten a time interval between C–D (F–A). However, in order to prevent the power source 27 from being shorted, this timing cannot be set at a time earlier than time F (A).

Next, a third embodiment of the present invention will be described.

Figure 19:
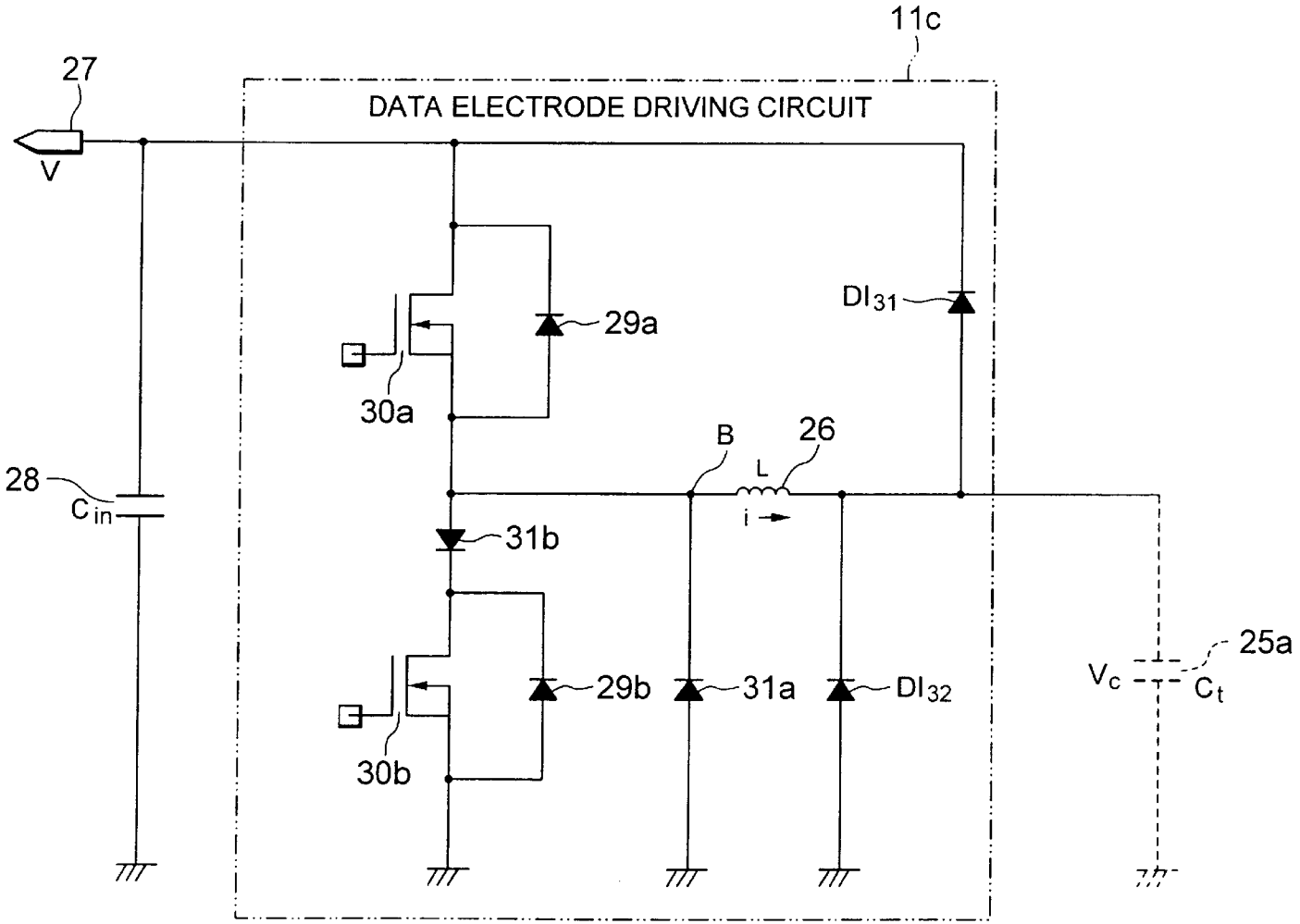
FIG. 19 is a circuit diagram that shows the circuit structure of a data electrode driving circuit according to a third embodiment of the present invention.
Figure 20:
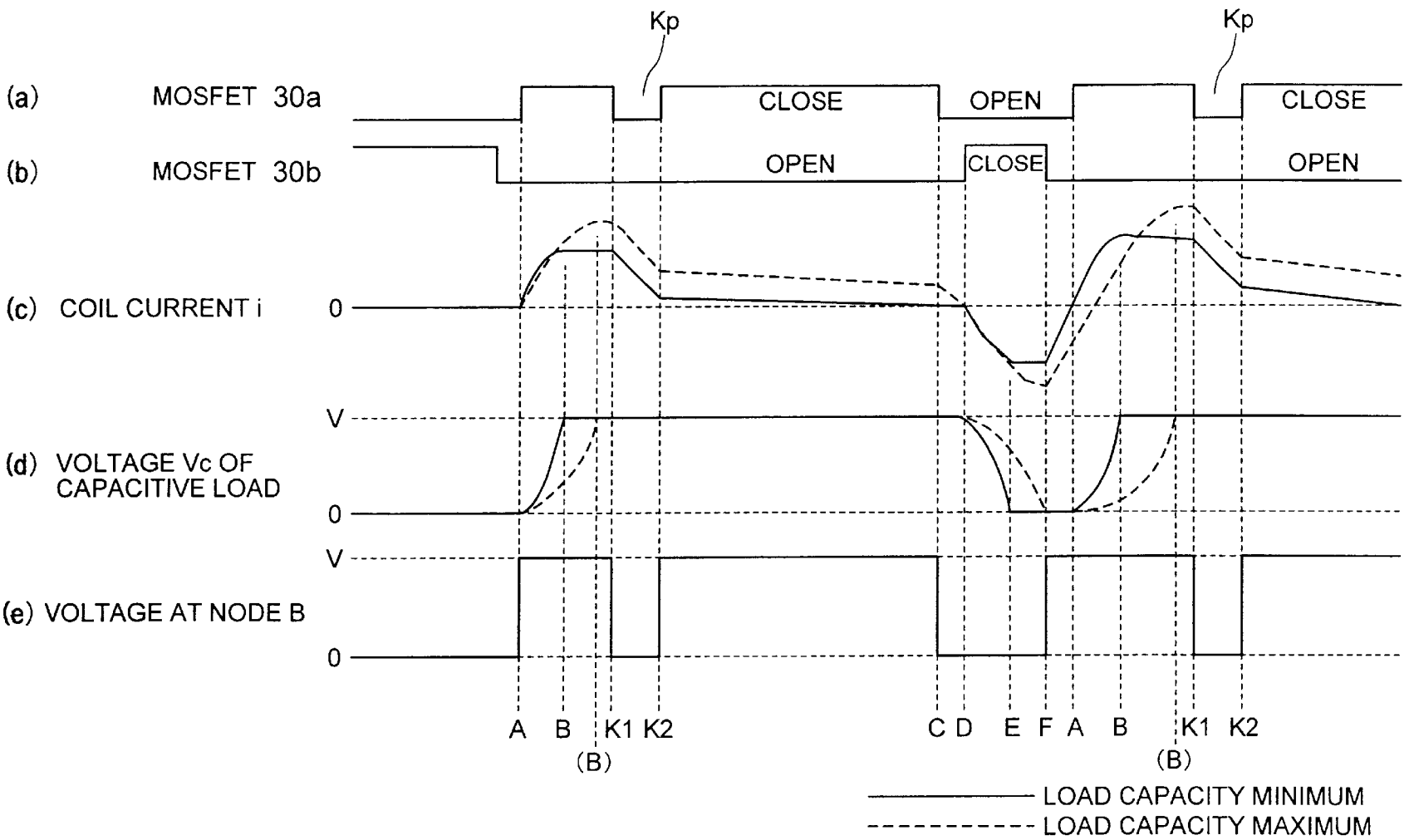
FIG. 20 is a timing chart for explaining the operation of this driving circuit.

FIG. 19 is a circuit diagram that shows the circuit structure of a data electrode driving circuit according to the third embodiment of the present invention, and FIG. 20 is a timing chart for explaining the operation of this driving circuit.

The structure of the data electrode driving circuit 11*c* of this embodiment differs greatly from that of the first embodiment in that, as shown in (a) of FIG. 20, a regenerating pulse Kp is applied to the MOSFET switch 30*a* during a flywheel-current-sustaining period (flywheel period) so as to accelerate the regenerating of the flywheel current, and, in addition, the current is regenerated through a high-speed diode 31*a* that has a short reverse recovery time instead of the parasitic diode 29*b* that has a long reverse recovery time.

The flywheel current is not lossless. In the flywheel current sustaining circuit, the flywheel current is gradually consumed by the forward-direction voltage drop of the diodes $DI_{31}$ and $DI_{32}$, the ON resistance of the MOSFET switches 30*a* and 30*b*, and the DC resistance component of the coil 26. Therefore, the improvement of the current regenerating efficiency is lowered in correspondence with its consumption. Accordingly, in this embodiment, especially at a positive current phase having a long flywheel period and immediately after the current i flowing through the coil 26 reaches the maximum, a regenerating pulse Kp (negative pulse) is applied to the MOSFET switch 30*a* so as to compulsorily accelerate the current regenerating, and thus the energy loss caused by a decrease in the flywheel current is lessened. In this case, if the voltage $V_c$ of the capacitive load 25*a* falls because of applying a regenerating pulse Kp thereto in a state in which the discharge of all the display cells that have undergone write-selection has not yet been completed, an unfavorable influence will be exerted upon a picture quality. Therefore, in this embodiment, the width of the regenerating pulse is set to have such a length as not to allow commutation to occur in the coil 26.

Further, in the data electrode driving circuit 11*c*, the high-speed diode 31*a* that has a short reverse recovery time and in which the direction from the earth terminal to node B is defined as forward direction is connected between a connection point (node B), which is common among the MOSFET switch 30*a*, the MOSFET switch 30*b*, and the coil 26, and the earth terminal, as shown in FIG. 19. Accordingly, in order to prevent the regenerating current from flowing through the parasitic diode 29*b*, the diode 31*b* in which the direction from node B to the MOSFET switch 30*b* is defined as forward direction is connected between node B and the MOSFET switch 30*b*.

The reason why the use of the parasitic diode 29*b* is abandoned is as follows. In general, the parasitic diode of the power MOSFET switch has a long reverse-recovery time. If the current regenerating is carried out by the use of this parasitic diode 29*b*, a through-current that flows through the path of (power source 27)→(MOSFET switch 30*a* in closed state)→(diode 31*b*)→(parasitic diode 29*b*)→(earth terminal) can flow through the parasitic diode 29*b* until the parasitic diode 29*b* that has maintained an ON state to the last moment makes a reverse recovery when the MOSFET switch 30*a* is closed after the regenerating pulse Kp is applied. Since this brings about a decline in the energy efficiency, the use of the parasitic diode 29*b* is abandoned.

Next, the operation of this example will be described with reference to FIG. 19 and FIG. 20.

On the assumption that the voltage of the capacitive load 25*a* is 0[V], and the electric current flowing through the coil 26 is also 0[A], and the MOSFET switches 30*a* and 30*b* are each in an open state (State 0), the stage proceeds from State 0 to State A at time "A".

(1) State A

When the MOSFET switch 30*a* is closed (MOSFET 30*a* of (a) of FIG. 20) at time "A", a power-supply voltage V is applied to a serial resonance circuit (node B) made up of the coil 26 and the capacitive load 25*a* (voltage of node B of (e) of FIG. 20), and the capacitive load 25*a* begins to be charged. The electric current i flowing through the coil 26 begins to oscillate according to an oscillation equation of the natural oscillation frequency f0, and rises (coil current i of (c) of FIG. 20 and voltage $V_c$ of the capacitive load of (d) of FIG. 20). The voltage $V_c$ of the capacitive load 25*a* rises toward a value of twice the power-supply voltage V. In (c) and (d) of FIG. 20, the broken line indicates a current-voltage waveform when the load capacity $C_t$ is the maximum, and the solid line indicates a current-voltage waveform when the load capacity $C_t$ is the minimum.

(2) State B

As shown in FIG. 19, when the voltage $V_c$ of the capacitive load 25*a* exceeds the power-supply voltage V (voltage $V_c$ of the capacitive load of (d) of FIG. 20) at time B, the diode $DI_{31}$ conducts a current, and, accordingly, the voltage $V_c$ of the capacitive load 25*a* is clamped at the power-supply voltage V. As a result, the resonance stops. Time B is the moment when a quarter of the natural oscillation cycle time has elapsed from time "A". An electric current i that flows through the coil 26 at time B is the maximum electric current in resonating (coil current i of (c) of FIG. 20). With time B as a starting point, this current circulates through the closed loop (i.e., flywheel current sustaining circuit) of (coil 26)→(diode $DI_{31}$)→(MOSFET switch 30*a* in closed state), and continues the flywheel operation.

(3) State K1

Thereafter, a negative regenerating pulse Kp is input into the gate of the MOSFET switch 30*a* at time K1. The regenerating pulse Kp is supplied by a timing control circuit not shown.

Time K1 is set at the time immediately after the current i flowing through the coil 26 reaches the maximum when the load capacity $C_t$ is the maximum. The reason is that, since the current i of the coil 26 latest reaches the maximum when the load capacity $C_t$ is the maximum, a regenerating pulse can be applied during the flywheel period if the application timing of the regenerating pulse is caused to coincide with this time no matter how the load capacity changes. When the regenerating pulse Kp is input into the MOSFET switch 30*a*, the MOSFET switch 30*a* is opened (MOSFET 30*a* of (a) of FIG. 20), and the loop of the flywheel current i is shut off. Accordingly, in order to sustain or maintain the flywheel current, the voltage of node B rapidly falls, and further falls below the earth potential, so that the diode 31*a* conducts the current.

Thereby, the flywheel current i is regenerated into the power source 27 through the path of (diode 31*a*)→(coil 26)→(diode $DI_{31}$) as shown in FIG. 19, and the current energy saved in the coil 26 is returned to the power source 27. The flywheel current i flowing through the coil 26 decreases in correspondence with the regenerating (coil current of (c) of FIG. 20).

However, in this example, the width of the regenerating pulse Kp must be set to have such a length as to not allow commutation to occur in the coil 26 when the load capacity is the minimum. In other words, the pulse must be set to stop immediately before the coil current reaches zero when the load capacity is the minimum. The reason is to prevent the coil current from reversing and to prevent the output voltage from falling. A corresponding flywheel current flows when the load capacity is the maximum even past time K2 by this regenerating pulse of fixed timing (coil current i of (c) of FIG. 20). It is noted that the voltage $V_c$ of the capacitive load 25*a* continues to sustain the power-supply voltage V required for panel driving, even when the regenerating pulse Kp is being applied (voltage $V_c$ of capacitive load of (d) of FIG. 20).

(4) State K2

When the MOSFET switch 30*a* is closed at time K2 when the regenerating pulse Kp leaves (MOSFET 30*a* of (a) of FIG. 20), the power-supply voltage V is again applied to the serial resonance circuit (node B) (voltage of node B of (e) of FIG. 20). However, since the voltage $V_c$ of the capacitive load 25*a* remains clamped at the power-supply voltage V, the slight remaining current of the coil 26 (coil current i of (c) of FIG. 20) circulates through the closed loop of (coil 26)→(diode $DI_{31}$)→(MOSFET switch 30*a* in closed state), and continues the flywheel operation.

(5) State C

When the MOSFET switch 30*a* is opened at time C (MOSFET 30*a* of (a) of FIG. 20), the flywheel current i has the loop shut off. Accordingly, in order to sustain the current, the voltage of node B falls sharply, and further falls below the earth potential so as to allow the parasitic diode 29*b* to conduct a current. Thereby, the flywheel current i is regenerated into the power source 27 through the path of (diode 31*a*)→(coil 26)→(diode $DI_{31}$) shown in FIG. 19, and the current energy remaining in the coil 26 is returned to the power source 27.

(6) State D

Thereafter, when the MOSFET switch 30*b* is closed at time D (MOSFET 30*b* of (b) of FIG. 20), the voltage $V_c$ of the capacitive load 25*a* begin s to oscillate according to the oscillation equation (natural oscillation frequency f0) of this resonance circuit, and falls toward the negative value −V of the power-supply voltage V (voltage $V_c$ of the capacitive load of (d) of FIG. 20). The current i flowing through the coil 26 also oscillates according to the oscillation equation (natural oscillation frequency f0) of the resonance circuit, and falls (coil current i of (c) of FIG. 20).

(7) State E

Since the diode $DI_{32}$ conducts a current when the voltage $V_c$ of the capacitive load 25*a* falls below the earth potential, as shown in FIG. 19, the voltage $V_c$ of the capacitive load 25*a* is clamped at the earth potential (voltage $V_c$ of the capacitive load of (d) of FIG. 20). As a result, the resonance stops at time E. With time E as a starting point, this current circulates through the closed loop (i.e., flywheel current sustaining circuit) of (coil 26)→(diode 31*b*)→(MOSFET switch 30*b* in closed state)→(diode $DI_{32}$) shown in FIG. 19, and continues the flywheel operation.

(8) State F

When the MOSFET switch 30*b* is opened at time F (MOSFET 30*b* of (b) of FIG. 20), the flywheel current has the loop shut off. Accordingly, in order to sustain the current, the voltage at point B rises sharply, and further rises above the power-supply voltage so as to allow the parasitic diode 29*a* to conduct the current.

Thereby, the flywheel current i is regenerated into the power source 27 through the path of (diode $DI_{32}$)→(coil 26)→(parasitic diode 29*a*) shown in FIG. 19, and the current energy saved in the coil 26 is returned to the power source 27. The flywheel current i flowing through the coil 26 decreases interrelatedly with the regenerating (coil current of (c) of FIG. 20).

A voltage pulse train is supplied to the capacitive load 25*a* while repeating the series of operations described above. According to the structure of this example, since the current regenerating is compulsorily accelerated by applying the regenerating pulse Kp, the energy loss of the flywheel current can be reduced, and the current regenerating efficiency can be improved correspondingly. Further, since the high-speed diode having a short reverse recovery time is used instead of the parasitic diode 29*b* of the power MOSFET switch that is inferior in the reverse recovery time, the disadvantage caused when the regenerating pulse is applied (i.e., a decline in the electrical efficiency caused by the through-current) can also be prevented.

Next, a fourth embodiment of the present invention will be described.

Figure 21:
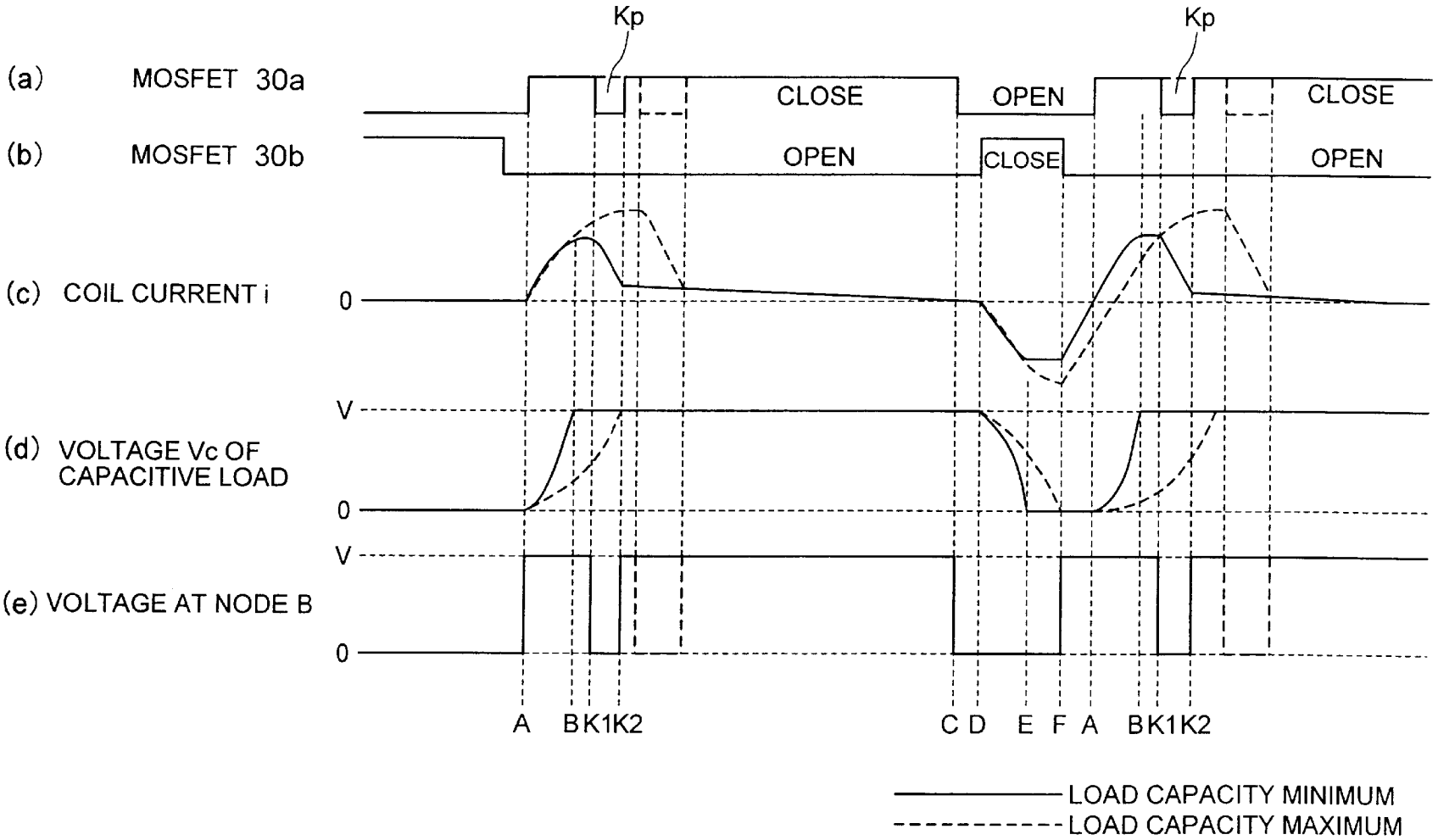
FIG. 21 is a timing chart for explaining the operation of a data electrode driving circuit according to a fourth embodiment of the present invention.

FIG. 21 is a timing chart for explaining the operation of a data electrode driving circuit according to the fourth embodiment of the present invention.

As shown in FIG. 21, in the fourth embodiment, the number of selected data electrodes is sequentially calculated per write scanning, and, based on the resultant number thereof, suitable application timing and pulse width of a regenerating pulse Kp are controlled. .

As shown in FIG. 21, time B, at which the voltage $V_c$ of a capacitive load 25*a* is clamped at a power-supply voltage V and at which a flywheel current i occurs, depends on a natural oscillation cycle, and, accordingly, depends on a load capacity. In other words, when the load capacity $C_t$ is the maximum, it is clamped at the latest time, and, when the load capacity $C_t$ is the minimum, it is clamped at the earliest time. Further, the flywheel current i that flows through the coil at clamping time B has the maximum amount of current when the load capacity $Ct$ is the maximum, and has the minimum amount of current when the load capacity $C_t$ is the minimum. Therefore, in this embodiment, the application timing of a regenerating pulse Kp is controlled to be gradually or continuously delayed proportionately with the increase in the load capacity $C_t$, and, on the other hand, the pulse width thereof is controlled to be lengthened proportionately with the increase in the load capacity $C_t$.

In the third embodiment, the control is easily carried out as a result of the fixation of the regenerating pulse, but, disadvantageously, the regenerating efficiency of the flywheel current is low when the load is the maximum. By contrast, according to the structure of this fourth embodiment, almost all of the flywheel current can be regenerated independently of the load capacity although the control of the regenerating pulse is required. Therefore, the flywheel loss can be reduced.

As a modification of the fourth embodiment, the timing of the regenerating pulse Kp may be determined on the basis of a detection result obtained by detecting a change in the current flowing through the coil 26. In this case, it is practically preferable to additionally monitor and detect the voltage $V_c$ of the capacitive load because consideration must be given to, for example, a differential value, in order to modulate the regenerating pulse while detecting only a change in the current of the coil, especially when the start timing of the regenerating pulse is detected.

Next, a fifth embodiment of the present invention will be described.

Figure 22:
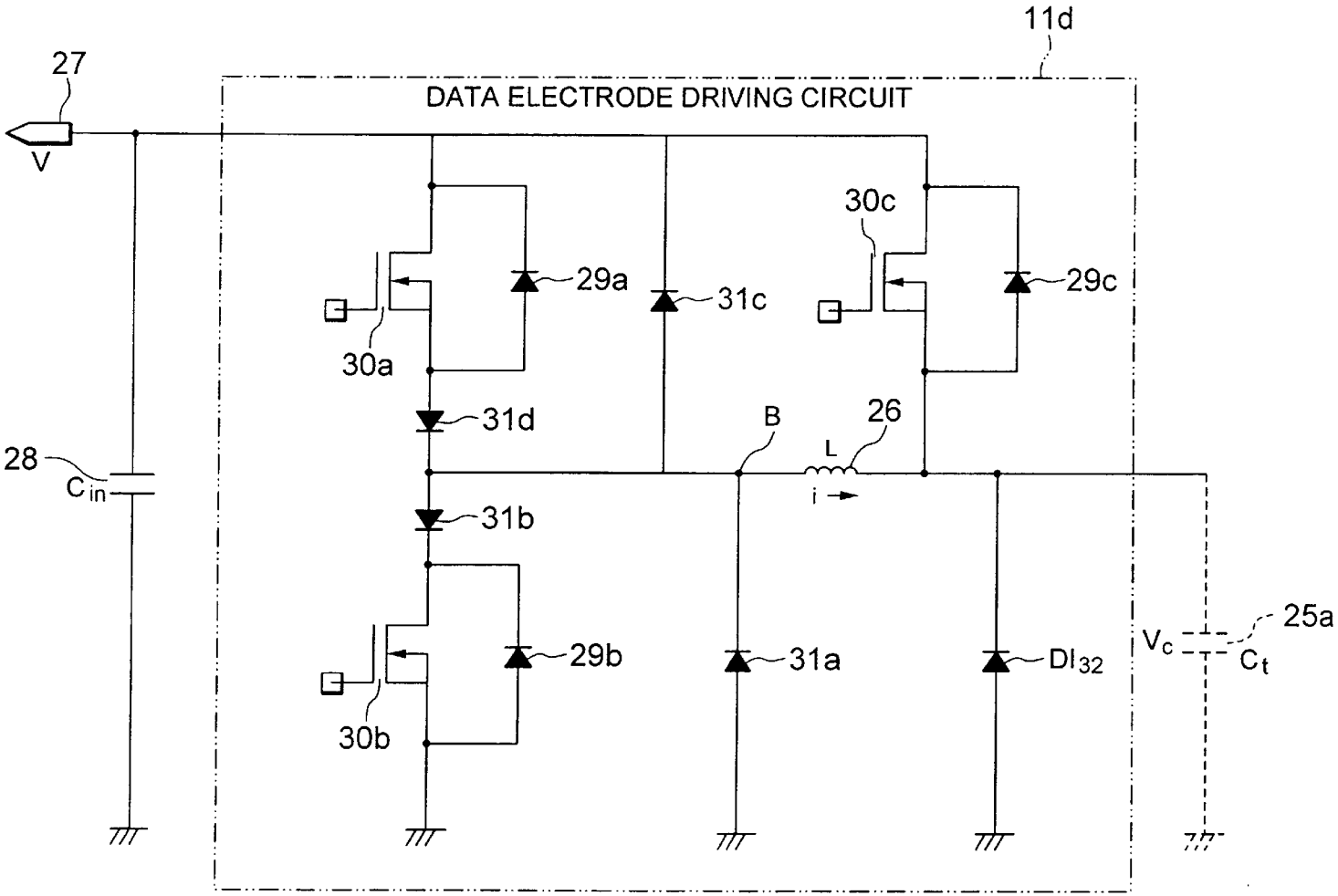
FIG. 22 is a circuit diagram that shows the circuit structure of a data electrode driving circuit according to a fifth embodiment of the present invention.
Figure 23:
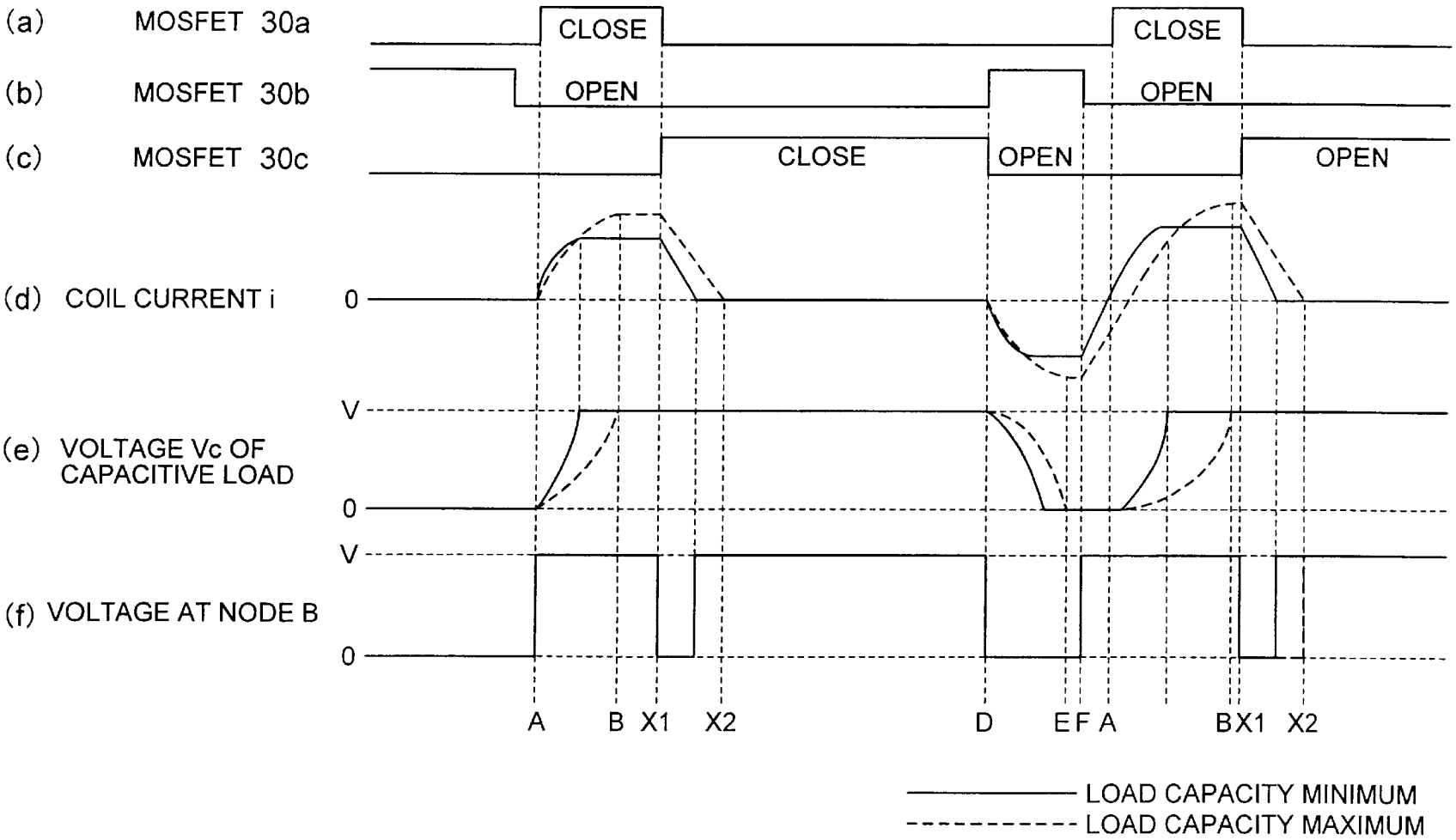
FIG. 23 is a timing chart for explaining the operation of this driving circuit.

FIG. 22 is a circuit diagram that shows the circuit structure of a data electrode driving circuit according to the fifth embodiment of the present invention, and FIG. 23 is a timing chart for explaining the operation of this driving circuit.

In this fifth embodiment, the MOSFET switch 30*c* including the parasitic diode 29*c* is disposed instead of the diode $DI_{31}$, and the regenerating of the flywheel current is compulsorily accelerated by closing the MOSFET switch 30*c* without any regenerating pulses.

As shown in FIG. 22, a high-speed diode 31*c* that has a short reverse recovery time and in which the direction from node B to the power source 27 is defined as the forward direction is connected between a connection point (node B), which is common among the MOSFET switch 30*a,* the MOSFET switch 30*b,* and the coil 26, and the power source 27. Accordingly, in order to prevent the regenerating current from flowing through the parasitic diode 29*a,* the diode 31*d* in which the direction from the MOSFET switch 30*a* to node B is defined as forward direction is connected between node B and the MOSFET switch 30*a*.

Next, the operation of the fifth embodiment will be described with reference to FIG. 22 and FIG. 23.

On the assumption that the voltage of the capacitive load 25*a* is 0[V], and the electric current flowing through the coil 26 is also 0[A], and the MOSFET switches 30*a,* 30*b,* and 30*c* are each in an open state (State 0), the stage proceeds from State 0 to State A at time "A".

(1) State A

When the MOSFET switch 30*a* is closed (MOSFET 30*a* of (a) of FIG. 23) at time "A", a power-supply voltage V is applied to a serial resonance circuit (node B) made up of the coil 26 and the capacitive load 25*a* (voltage of node B of (e) of FIG. 23), and the capacitive load 25*a* begins to be charged. The electric current i flowing through the coil 26 begins to oscillate according to an oscillation equation of the natural oscillation frequency f0, and rises (coil current i of (d) of FIG. 23 and voltage $V_c$ of the capacitive load of (e) of FIG. 23). The voltage $V_c$ of the capacitive load 25*a* rises toward a value of twice the power-supply voltage V.

(2) State B

When the voltage $V_c$ of the capacitive load 25*a* exceeds the power-supply voltage V (coil current i of (d) of FIG. 23) at time B, the parasitic diode 29*c* shown in FIG. 22 conducts a current, and, accordingly, the voltage $V_c$ of the capacitive load 25*a* is clamped at the power-supply voltage V. As a result, the resonance stops. Time B is the moment when a quarter of the natural oscillation cycle time has elapsed from time "A". An electric current i that flows through the coil 26 at time B is the maximum electric current in resonating (MOSFET 30*c* of (c) of FIG. 23). With time B as a starting point, this current circulates through the closed loop (i.e., flywheel current sustaining circuit) of (coil 26)→(parasitic diode 29*c*)→(MOSFET switch 30*a* in closed state)→(diode 31*d*), and continues the flywheel operation.

(3) State X1

Thereafter, the MOSFET switch 30*a* is opened, and the MOSFET switch 30*c* is closed at time X1 (MOSFET 30*a* of (a) of FIG. 23, and MOSFET 30*c* of (c) of FIG. 23). Time X1 is set at time immediately after the current i flowing through the coil 26 reaches the maximum when the load capacity Ct is the maximum. When the MOSFET switch 30*a* is opened (MOSFET 30*a* of (a) of FIG. 23), the loop of the flywheel current i is shut off. Accordingly, in order to sustain or maintain the flywheel current, the voltage at point B rapidly falls, and further falls below the earth potential, so that the diode 31*a* conducts the current.

Thereby, the flywheel current i is regenerated into the power source 27 through the path of (diode 31*a*)→(coil 26)→(MOSFET 30*c*) shown in FIG. 22, and the current energy saved in the coil 26 is returned to the power source 27. The flywheel current i flowing through the coil 26 decreases in correspondence with the regenerating (coil current i of (d) of FIG. 23).

However, the voltage $V_c$ of the capacitive load 25*a* is kept clamped at the power-supply voltage V by means of the MOSFET 30*c* in the closed state even if the current i of the coil 26 decreases and reaches zero (voltage $V_c$ of the capacitive load of (e) of FIG. 23).

(4) State X2

When the current i of the coil 26 reaches zero at time X2, the voltage at point B rises and is clamped at the power-supply voltage V (voltage of node B of (f) of FIG. 23).

(5) State D

Thereafter, when the MOSFET switch 30*c* is opened and the MOSFET switch 30*b* is closed at time D (MOSFET 30*b* of (b) of FIG. 23 and MOSFET 30*c* of (c) of FIG. 23), the charging voltage $V_c$ of the capacitive load 25*a* is applied to the serial resonance circuit made up of the coil 26 and the capacitive load 25*a,* and the capacitive load 25*a* begins to discharge (voltage $V_c$ of the capacitive load of (e) of FIG. 23).

The current i flowing through the coil 26 begins to oscillate at the natural oscillation frequency f0, and falls (coil current of (d) of FIG. 23). On the other hand, the voltage $V_c$ of the capacitive load 25*a* also begins to oscillate at the natural oscillation frequency f0, and falls toward the negative value −V of the power-supply voltage V (coil current i of (d) of FIG. 23).

(7) State E

Since the diode $DI_{32}$ shown in FIG. 22 conducts a current when the voltage $V_c$ of the capacitive load 25*a* falls below the earth potential, the voltage of the capacitive load 25*a* is clamped at the earth potential (voltage of the capacitive load of (e) of FIG. 23). As a result, the resonance stops at time E. The voltage V of the capacitive load 25*a* is clamped at the earth potential at time E that is latest, when the load capacity $V_c$ is the maximum. With time E as a starting point, this current circulates through the closed loop (i.e., flywheel current sustaining circuit) of (coil 26)→(diode 31*b*)→(MOSFET switch 30*b* in closed state)→(diode $DI_{32}$) shown in FIG. 22, and continues the flywheel operation.

(8) State F

Thereafter, when the MOSFET switch 30*b* is opened at time F past clamping time E, which is latest, when the load capacity $V_c$ is the maximum (MOSFET 30*b* of (b) of FIG. 23), the flywheel current has the loop shut off. Accordingly, in order to sustain the current, the voltage at point B rises sharply, and further rises above the power-supply voltage so as to allow the parasitic diode 31*c* to conduct the current.

Thereby, the flywheel current i is regenerated into the power source 27 through the path of (diode $DI_{32}$)→(coil 26)→(diode 31*c*) shown in FIG. 22, and the current energy saved in the coil 26 is returned to the power source 27. The flywheel current i flowing through the coil 26 decreases interrelatedly with the regenerating (coil current i of (d) of FIG. 23).

A voltage pulse train is supplied to the capacitive load 25*a* while repeating the series of operations described above. According to the structure of this example, since the optimizing control of the regenerating pulse timing is not needed, the loss of the flywheel current can be reduced by performing simple control.

Next, a sixth embodiment of the present invention will be described.

Figure 24:
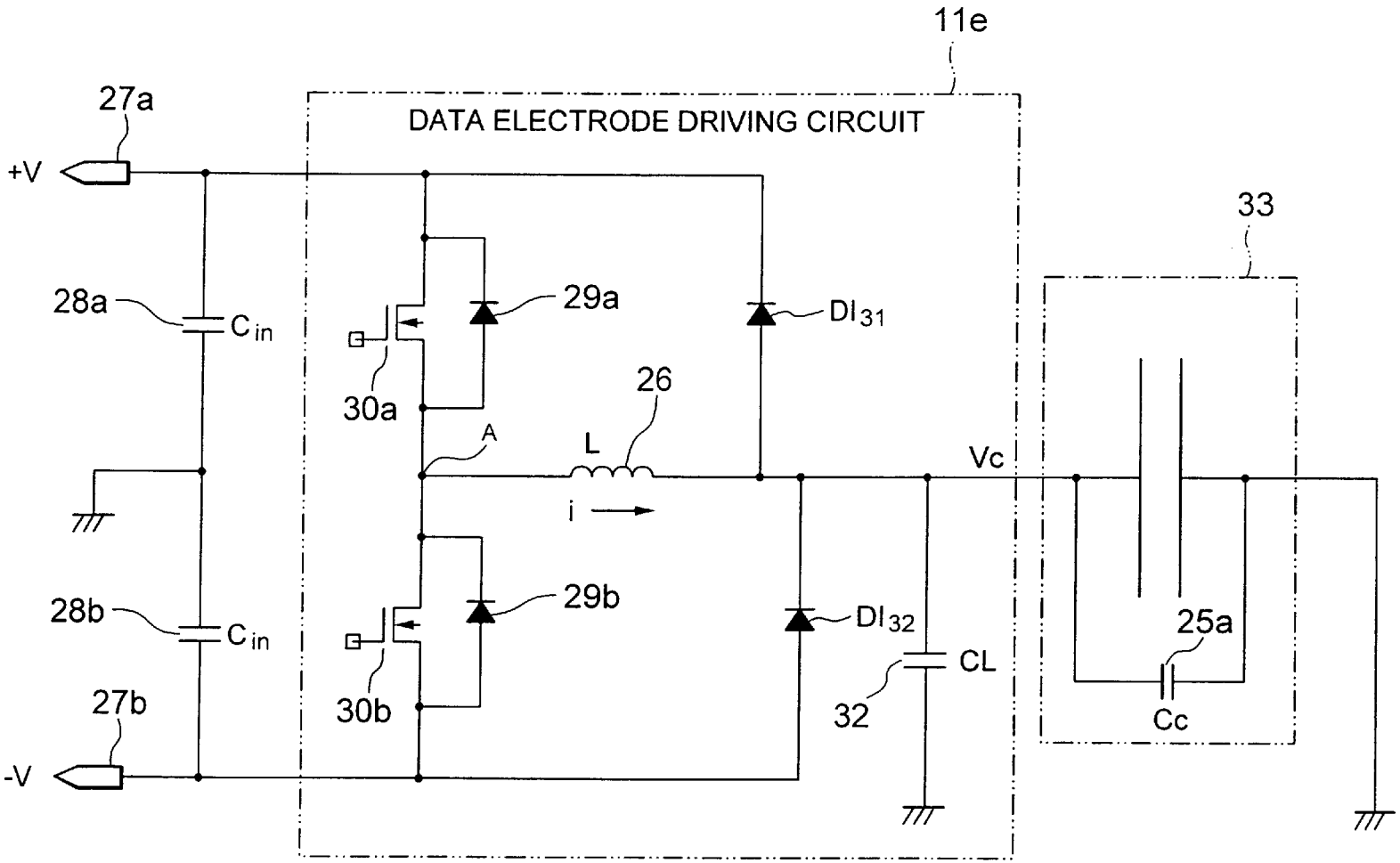
FIG. 24 is a circuit diagram that shows the circuit structure of a data electrode driving circuit according to a sixth embodiment of the present invention.
Figure 25:
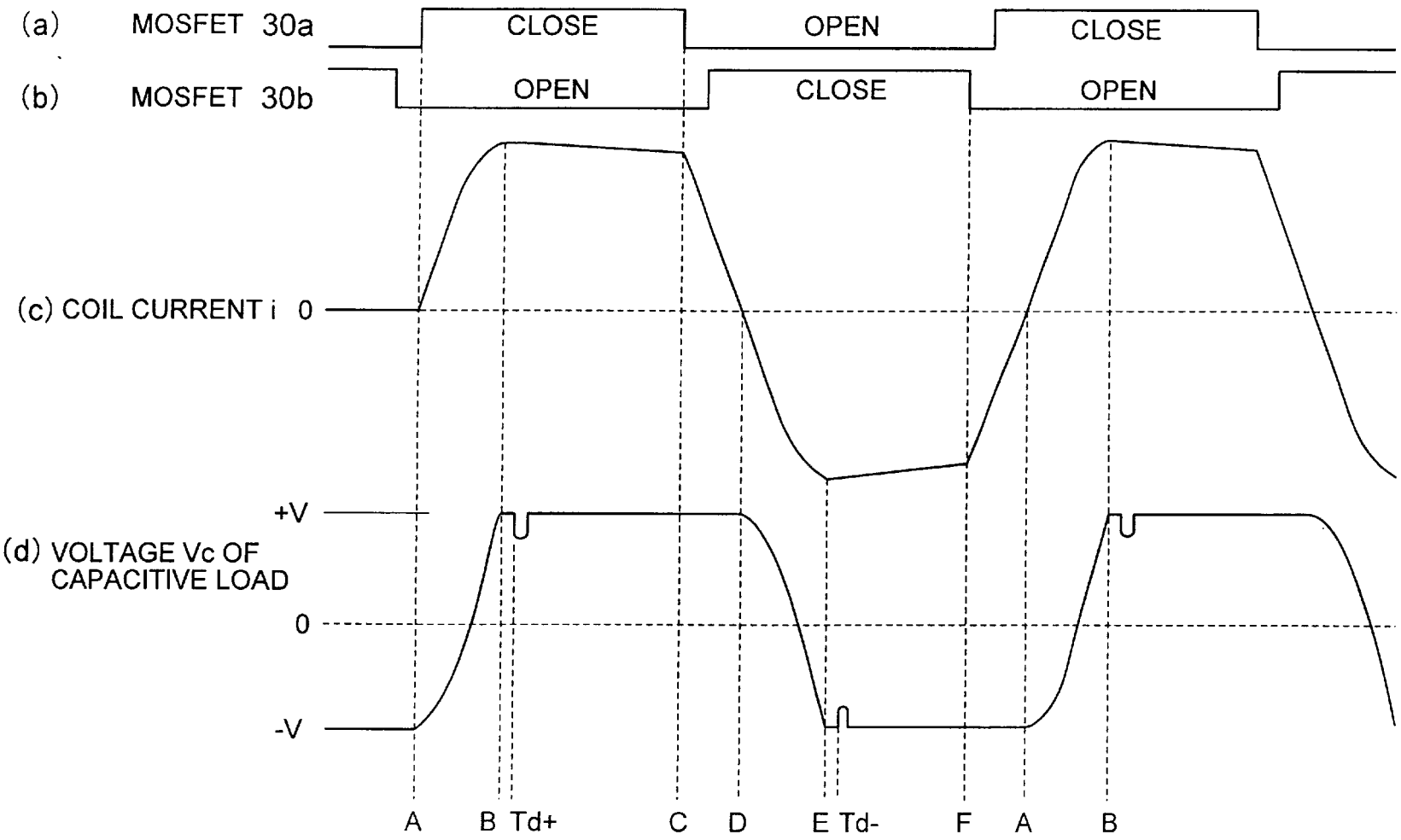
FIG. 25 is a timing chart that shows the operation of the driving circuit shown in FIG. 24.

FIG. 24 is a circuit diagram that shows the circuit structure of a data electrode driving circuit according to the sixth embodiment of the present invention, and FIG. 25 is a timing chart that shows the operation of this driving circuit.

The driving circuit of this sixth embodiment differs from the driving circuit of the first embodiment in that a load capacity 32 is connected between the capacitive load 25*a* (FIG. 24) in the plasma display panel 33 and the coil 26, i.e., between the load-driving output end of the driving circuit of the capacitive load and the earth potential. The capacitive load 25*a* represents the capacity of the plasma display panel 33. Additionally, the power source supplied to this driving circuit is a bipolar one that comprises a positive power source 27*a*(+V) and a negative power source 27*b*(−V). That is, a condenser 28*a* having a capacity $C_{in}$ is disposed between the positive power source 27*a* and the earth potential, and a condenser 28*b* having a capacity $C_{in}$ is disposed between the negative power source 27*b* and the earth potential. Additionally, the low-potential side of the MOSFET switch 30*b*, the parasitic diode 29*b*, and the diode $DI_{32}$ is connected to the negative electrode power source 27*b*(−V), not to the earth potential. The structure excluding this arrangement is the same as the structure of the driving circuit according to the first embodiment shown in FIG. 16. In this embodiment, since the load capacity 32 is disposed, the operating current of the driving circuit of this embodiment increases, and even a sustaining-luminous discharge current can be supplied when this driving circuit is used for the sustaining-luminous driving of the plasma display panel.

Next, the operation of the driving circuit according to this embodiment will be described with reference to FIG. 24 and FIG. 25. On the assumption that the voltage of the capacitive load 25*a* is −V[V], and the electric current flowing through the coil 26 is 0[A], and the MOSFET switches 30*a* and 30*b* are each in an open state (State 0), the stage proceeds from State 0 to State A at time "A".

(1) State A

When the MOSFET switch 30*a* is closed at time "A", a power-supply voltage 2V is applied to a serial resonance circuit (node "A") made up of the coil 26 and the total capacity of the capacitive load 25*a* and a load capacity 32, and the capacitive load 25*a* and the load capacity 32 begin to be charged. The electric current i flowing through the coil 26 begins to oscillate according to the oscillation equation of the natural oscillation frequency f0, and rises. The voltage $V_c$ of the capacitive load 25*a* rises toward a value twice that of the power-supply voltage.

(2) State B

When the voltage $V_c$ of the capacitive load 25*a* exceeds the positive power source voltage +V, the diode $DI_{31}$ shown in FIG. 24 conducts a current, and therefore the voltage $V_c$ of the capacitive load 25*a* is clamped at the positive power source voltage +V. As a result, the resonance stops at time B. As can be drawn out from Equation (5), time B is the moment when the time of a quarter of the natural oscillation cycle elapses from time "A". As can be drawn out from Equation (4), an electric current i that flows through the coil 26 at time B is the maximum electric current in resonating (coil current i of (c) of FIG. 25). With time B as a starting point, this current circulates through the closed loop (i.e., flywheel current sustaining circuit) of (coil 26)→(diode $DI_{31}$)→(switch $SW_{31}$ in closed state), and continues the flywheel operation.

(3) State Td+

A large current that follows the luminous discharge of the plasma display panel 33 is generated at time Td+. Since this current has a steep transient, the path of (power source 27*a*)→(MOSFET switch 30*a*)→(coil 26) can hardly contribute to the supply of this current because of the influence of the inductance of the coil 26. However, the current caused by the luminous discharge is rapidly supplied by electric charges with which the load capacity 32 and the capacitive load 25 are charged. As a result, fluctuations in voltage $V_c$ of the capacitive load 25*a* are suppressed to be slight.

(4) State C

When the MOSFET switch 30*a* is opened at time C, the flywheel current i has the loop shut off. Accordingly, in order to sustain the current, the voltage of node "A" falls sharply, and further falls below the earth potential so as to allow the parasitic diode 29*b* to conduct a current.

Thereby, the flywheel current i is regenerated into the power sources 27*a* and 27*b* through the path of (parasitic diode 29*b*)→(coil 26)→(diode $DI_{31}$) shown in FIG. 24, and the current energy saved in the coil 26 is returned to the power sources 27*a* and 27*b*. The flywheel current i flowing through the coil 26 decreases interrelatedly with the regenerating. When the MOSFET switch 30*b* is closed past time C, the circulation path changes into a path in which the voltage drop of the voltage $V_c$ becomes smaller, i.e., into a path of (MOSFET switch 30*b*)→(coil 26)→(diode $DI_{31}$), and the regenerating efficiency is improved even more.

(5) State D

The current i of the coil 26 reaches zero at time D, and the regenerating to the power source 27*a* is completed. Since the MOSFET switch 30*b* has already been closed, the power-supply voltage −2V is applied to the serial resonance circuit that comprises the coil 26 and the total capacity resulting from the addition of the load capacity 32 to the capacitive load 25, and the current i flowing through the coil 26 begins to oscillate at the natural oscillation frequency f0, and falls. On the other hand, the voltage $V_c$ of the capacitive load 25*a* also begins to oscillate at the natural oscillation frequency f0, and falls. As a result, the total capacity is charged to the negative potential.

(6) State E

Since the diode $DI_{32}$ conducts a current when the voltage $V_c$ of the capacitive load 25*a* falls below the negative power source voltage −V, as shown in FIG. 24, the voltage $V_c$ of the capacitive load 25*a* is clamped at the voltage −V. As a result, the resonance stops at time E. As can be drawn out from Equation (8), time E is the moment when the time of a quarter of the natural oscillation cycle elapses from time D. The electric current i that flows through the coil 26 at time E is the negative maximum electric current in resonating. With time E as a starting point, this current circulates through the closed loop (i.e., flywheel current sustaining circuit) of (coil 26)→(MOSFET switch 30*b* in closed state)→ (diode $DI_{32}$), and continues the flywheel operation.

(7) State Td−

A large current that follows the luminous discharge of the plasma display panel 33 is again generated at time Td−. Since this current has a steep transient, the path of (coil 26)→(MOSFET switch 30*b*)→(power source 27*b*) can hardly contribute to the supply of this current because of the influence of the inductance of the coil 26. However, the current caused by the luminous discharge is rapidly supplied by negative charges with which the load capacity 32 and the capacitive load 25 are charged. As a result, fluctuations in voltage $V_c$ of the capacitive load 25*a* are suppressed to be slight.

(8) State F

When the MOSFET switch 30*b* is opened at time F, the flywheel current has the loop shut off. Accordingly, in order to sustain the current, the voltage at point "A" rises sharply, and further rises above the power-supply voltage so as to allow the parasitic diode 29*a* to conduct the current.

Thereby, the flywheel current i is regenerated into the power sources 27*a* and 27*b* through the path of (diode $DI_{32}$)→(coil 26)→(parasitic diode 29*a*) shown in FIG. 24, and the current energy saved in the coil 26 is returned to the power sources 27*a* and 27*b*. The flywheel current i flowing through the coil 26 decreases interrelatedly with the regenerating.

When the MOSFET switch 30*a* is closed past time C, the circulation path changes into a path in which the voltage drop of the voltage Vc becomes smaller, i.e., into a path of (diode $DI_{32}$)→(coil 26)→(MOSFET switch 30*a*), and the regenerating efficiency is improved even more.

(1) (again) State A

At time "A" again, the current i of the coil 26 reaches zero, and the regenerating to the power sources 27*a* and 27*b* is completed. Since the MOSFET switch 30*a* has already been closed, the power-supply voltage 2V is again applied to the serial resonance circuit, and the charging of the total capacity begins while the current i of the coil 26 and the voltage V of the capacitive load 25*a* are rising.

The voltage pulse train can be supplied to the capacitive load 25*a,* and the sustaining luminous discharge current for the plasma display panel can be supplied by repeating the series of operations described above.

If the sustaining luminous discharge current of the plasma display panel is supplied through the driving circuit of the first embodiment, the voltage $V_c$ greatly changes with the sustaining luminous discharge because the sustaining luminous discharge current has a steep transient and because the driving circuit of the first embodiment does not include a path that can rapidly supply such current. Besides, since this change is subjected to a modulation by the display load, the display panel has difficulty in performing the sustaining luminescence uniformly and stably. Further, disadvantageously, unnecessary electromagnetic-wave radiation occurs because the change of the voltage $V_c$ is a high-speed transient and has high amplitude.

On the other hand, the driving circuit of the sixth embodiment has the load capacity 32 and, by this load capacity 32, is capable of rapidly supplying the sustaining luminous discharge current for the plasma display panel. This makes it possible to control the fluctuations of the voltage $V_c$. Thus, the voltage $V_c$ can be stabilized, and the display panel can perform uniform, stable sustaining-light emission. Additionally, unnecessary electromagnetic-wave radiation can be prevented from occurring.

The capacity Ct of the capacitive load 25*a* may be especially enlarged instead of disposing the load capacity 32. Further, when the load capacity 32 exerts an unfavorable influence during periods other than the sustaining discharge period of the plasma display panel, this influence can be excluded by providing a switch to the load capacity 32. On the other hand, the transient time of the sustaining driving waveform is increased by providing the load capacity 32. In other words, in FIG. 25, the time between time "A" and time B and the time between time D and time E become longer than a case in which the load capacity 32 is not provided. It is a countermeasure to adjust the transient time by reducing the inductance of the coil 26 if this is undesirable for the drive performance of the plasma display panel.

Next, a seventh embodiment of the present invention will be described.

Figure 26:
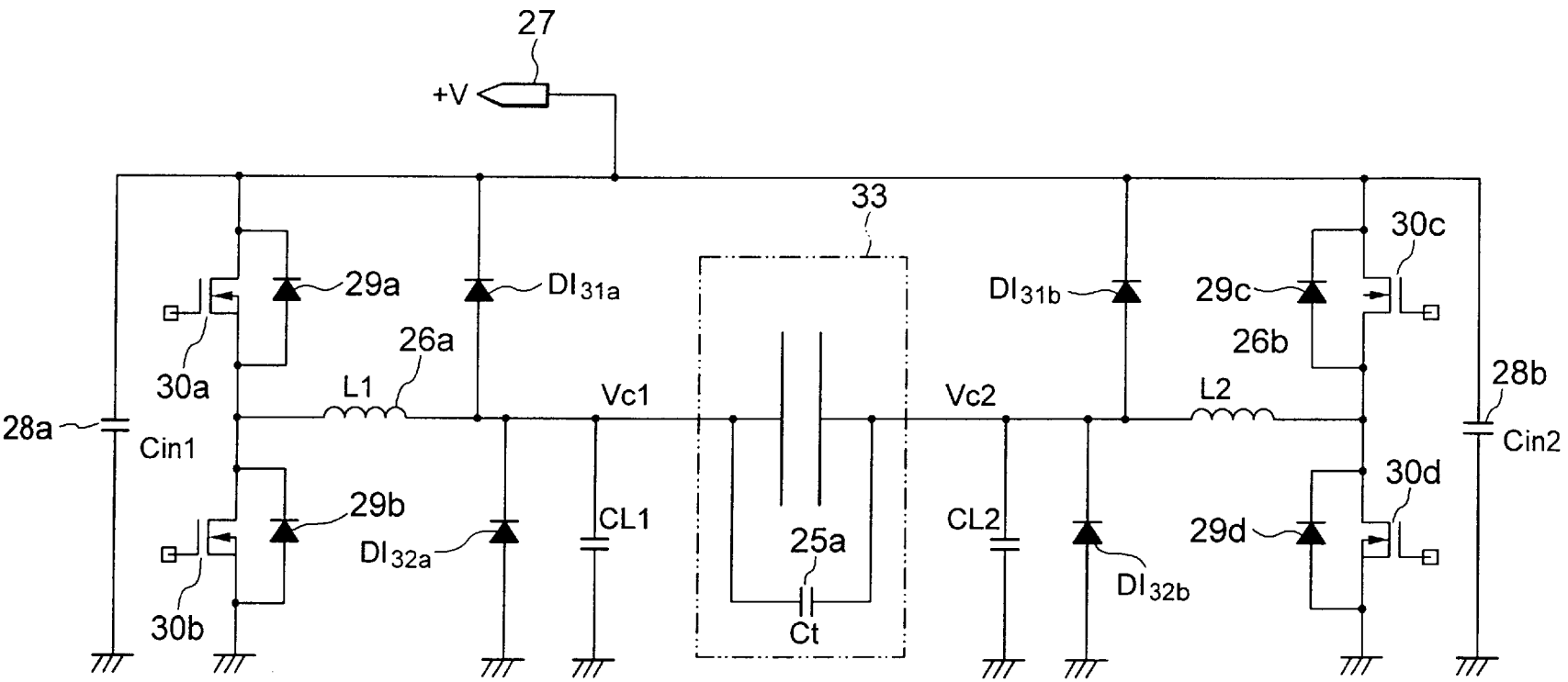
FIG. 26 is a circuit diagram that shows the circuit structure of a data electrode driving circuit according to a seventh embodiment of the present invention.
Figure 27:
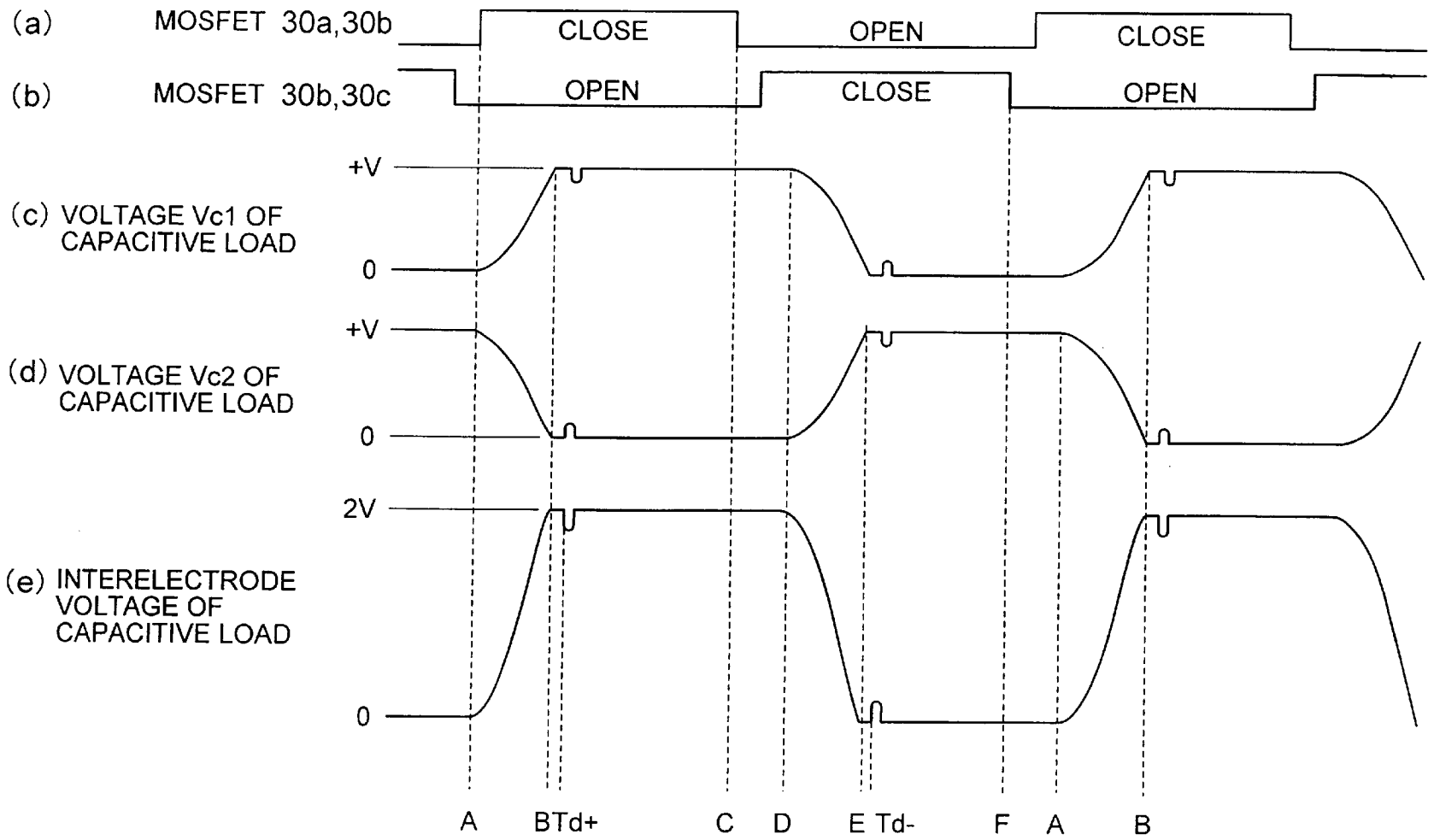
FIG. 27 is a timing chart that shows the operation of the driving circuit shown in FIG. 26.

FIG. 26 is a circuit diagram that shows the circuit structure of a data electrode driving circuit according to the seventh embodiment of the present invention, and FIG. 27 is a timing chart that shows the operation of this driving circuit.

In the seventh embodiment, two driving circuits, each of which are the same as in sixth embodiment, are provided, and they are connected to both sides of the plasma display panel 33. However, the power source for sustaining-drive to be used is only one positive power source 27(V). That is, a condenser 28*a* having a capacity $C_{in}$ is disposed between the positive power source 27 and the earth potential. The low-potential side of the MOSFET switches 30*b* and 30*d,* the parasitic diodes 29*b* and 29*d,* and the diodes $DI_{32a}$, and $DI_{32b}$ is connected to the earth potential.

In the seventh embodiment, voltage $V_{c1}$ and voltage $V_{c2}$ are applied to both sides of the capacitive load 25*a* of the plasma display panel 33, respectively. In this embodiment, as shown in FIG. 27, the voltage $V_{c2}$ is voltage +V when the voltage $V_{c1}$ has a voltage of 0V, and the voltage $V_{c2}$ falls when the voltage $V_{c1}$ rises, and, on the other hand, the voltage $V_{c2}$ rises when the voltage $V_{c1}$ falls, and the voltage $V_{c2}$ is 0V when the voltage $V_{c1}$ is +V. That is, the voltage $V_{c1}$ and the voltage $V_{c2}$ change so that the amount of the two always shows a constant value of approximately +V (voltage $V_{c1}$ of capacitive load of (c) of FIG. 27, and voltage $V_{c2}$ of capacitive load of (d) of FIG. 27). As a result, the voltage applied to the capacitive load 25*a* of the plasma display panel 33 shown in FIG. 26 varies between voltage 0V and voltage +2V (inter-electrode voltage of capacitive load of (e) of FIG. 27), and the behavior of this voltage is the same as that of the voltage $V_c$ of the sixth embodiment shown in FIG. 25.

Thus, in this embodiment, the number of power sources for sustaining-drive that is needed is one, and the voltage applied to the driving circuit is within the range of 0 to +V, and therefore an inter-electrode voltage necessary for the sustaining drive of the plasma display panel can be obtained by using a component whose voltage proof is lower than that of the sixth embodiment.

In this embodiment, the MOSFET switches 30*a* and 30*d* are driven with the same timing, and the MOSFET switches 30*b* and 30*c* are controlled with the same timing. However, they are not necessarily required to have the same timing.

The preferred embodiments of the present invention has been described hereinbefore referring to the attached drawings. However, the present invention is not limited to these embodiments, and can include design changes within a range that does not depart from the spirit of the present invention. For example, the switch may be a p-type MOSFET or may be a bipolar transistor, without being limited to the n-type MOSFET. Further, as long as it is AC drive, it may be an opposition discharge type without being limited to the surface discharge type, or it may be a two-electrode type without being limited to three-electrode type.

Further, in each embodiment, a case has been described in which the driving circuit of the present invention is applied to the plasma display panel. However, without being limited to this, an EL display panel may be used, as long as it is a capacity display panel. Further, it does not matter whether the power-supply voltage is higher or lower with respect to the earth potential. Further, although a case has been described in which the present invention is applied to the driving circuit for supplying a pulse to the data (row) electrode in the above embodiments, the scanning electrode can be used to drive the scanning electrode and/or the sustaining electrode.

What is claimed is:

1. A driving circuit for a capacitive load, which supplies a pulse to the capacitive load that is an electrode of a capacitive display panel, the driving circuit comprising:

a coil connected in series directly or indirectly to the capacitive load and making up a serial resonance circuit together with the capacitive load;

a first switch for applying a DC power source voltage output from a DC power source to the serial resonance circuit and causing first resonance to begin by closing the first switch;

a first clamping circuit for stopping the first resonance by clamping a voltage of the capacitive load at the DC power source voltage at time at which the voltage of the capacitive load begins to exceed the DC power source voltage after the first resonance starts;

a first flywheel current control circuit for bringing a current flowing through the coil into a first flywheel operational state and sustaining it when the first resonance stops;

a first electric-current regenerating circuit for regenerating the current in the first flywheel operational state to the DC power source;

a second switch for causing the serial resonance circuit to begin second resonance, with a charging voltage of the capacitive load as a source, by closing the second switch;

a second clamping circuit for clamping the voltage of the capacitive load at the earth potential and stopping the second resonance at the time at which the voltage of the capacitive load begins to fall below the earth potential after the second resonance begins;

a second flywheel current control circuit for bringing the current flowing through the coil into a second flywheel operational state and sustaining it when the second resonance stops; and a second electric-current regenerating circuit for regenerating the current of the second flywheel operational state to the DC power source.

2. The driving circuit according to claim 1, wherein the first electric-current regenerating circuit regenerates a part of the current in the first or second flywheel operational state to the DC power source in accordance with input timing of a regenerating pulse, and thereafter regenerates the remainder of the current that continues the first or second flywheel operation to the DC power source.

3. The driving circuit according to claim 1, wherein the first electric-current regenerating circuit includes a third switch, and regenerates the current in the first flywheel operational state to the DC power source when the third switch is closed.

4. The driving circuit according to claim 1, wherein the second electric-current regenerating circuit includes a fourth switch, and regenerates the current in the second flywheel operational state to the DC power source when the fourth switch is closed.

5. The driving circuit according to claim 1, further comprising a load capacity one end of which is connected between the coil and the capacitive load and the other end is connected to the earth potential.

6. The driving circuit according to claim 1, wherein the first clamping circuit includes a first diode connected so that the direction from the coil to the DC power source is a forward direction between the DC power source and a wiring line connecting the coil and the capacitive load, and the second clamping circuit includes a second diode connected so that a direction from an earth terminal to the coil is a forward direction between the wiring line and the earth terminal.

7. The driving circuit according to claim 1, wherein the first flywheel current control circuit is a closed loop made up of a coil, a first diode, and a first switch in the closed state that are connected in this order and in series, the first diode connected so that the direction of this order is a forward direction, and a control circuit that control the operations of the first and second switches, and the second flywheel current control circuit is a closed loop made up of the coil, a second switch in the closed state, and a second diode that are connected in this order and in series, the second diode connected so that the direction of this order is a forward direction, and a control circuit that control the operations of the first and second switches, and the currents in the first and second flywheel operational states flow through the coil in the opposite direction to each other.

8. The driving circuit according to claim 1, wherein the first electric-current regenerating circuit made up of a third diode connected in parallel with the second switch in the open state, a coil, and a first diode that are connected in this order and in series, the third and first diodes connected so that the direction of this order is a forward direction, is interposed between the DC power source and an earth terminal, and the second electric-current regenerating circuit made up of the second diode, the coil, and a fourth diode connected in parallel with the first switch in the open state that are connected in this order and in series, the second and fourth diodes connected so that the direction of this order is a forward direction, is interposed between the DC power source and the earth terminal, and when the first switch is opened in the case of the second switch is opened, the first electric-current regenerating circuit reaches a current regenerating state, whereas when the second switch is opened in the case of the first switch is opened, the second electric-current regenerating circuit reaches a current regenerating state.

9. The driving circuit according to claim 1, wherein the DC power source voltage is at a lower side than the earth potential, and, instead of the first clamping circuit, a third clamping circuit is provided for clamping the voltage of the capacitive load at the DC power source voltage when the voltage of the capacitive load begins to fall below the DC power source voltage and stopping the first resonance after the first resonance begins, and, instead of the second clamping circuit, a fourth clamping circuit is provided for clamping the voltage of the capacitive load at the earth potential and stopping the second resonance when the voltage of the capacitive load begins to exceed the earth potential after the second resonance begins.

10. A driving method for supplying a pulse train to a capacitive load that is an electrode of a capacitive display panel by the use of the driving circuit for the capacitive load as recited in claim 1, the driving method comprising the steps of:

at the first time point, closing the first switch and applying the DC power source voltage to the serial resonance circuit so as to begin the first resonance;

at the second time point at which the voltage of the capacitive load begins to exceed the DC power source voltage after the first resonance begins, clamping a charging voltage of the capacitive load at the DC power source voltage so as to stop the first resonance, and, at this time, sustaining the current flowing through the coil in a first flywheel operational state;

at the third time point, opening the first switch and regenerating the current in the first flywheel operational state to the DC power source;

at the fourth time point, closing the second switch and applying the charging voltage of the capacitive load to the serial resonance circuit so as to begin the second resonance;

at the fifth time point at which the voltage of the capacitive load begins to fall below the earth potential after the second resonance begins, clamping the voltage of the capacitive load at the earth potential so as to stop the second resonance and, at this time, sustaining the current flowing through the coil in a second flywheel operational state; and at the sixth time point, opening the second switch and regenerating the current in the second flywheel operational state to the DC power source, and supplying a pulse train to the capacitive load by repeating a series of operations from the first time point to the sixth time point.

11. The driving method according to claim 10, wherein the regenerating to the DC power source of the current in the first flywheel operational state by opening the first switch at the third time point is carried out such that the first switch is caused to be in an open state during a predetermined time, and, during this time, a part of the current in the first flywheel operational state is regenerated to the DC power source, and thereafter the first switch is again opened, and the remaining current that continues the first flywheel operation is regenerated to the DC power source.

12. The driving method according to claim 10, wherein the regenerating to the DC power source of the current in the second flywheel operational state by opening the second switch at the sixth time point is carried out such that the second switch is caused to be in an open state during a predetermined time, and, during this time, a part of the current in the second flywheel operational state is regenerated to the DC power source, and thereafter the second switch is again opened, and the remaining current that continues the second flywheel operation is regenerated to the DC power source.

13. The driving method according to claim 11, wherein a time point at which the first switch is brought into an open state is controlled according to the load capacity of the capacitive load.

14. The driving method according to claim 12, wherein a time point at which the second switch is brought into an open state is controlled according to the load capacity of the capacitive load.

15. The driving method according to claim 11, wherein a time width of the open state of the first switch is controlled according to the load capacity of the capacitive load.

16. The driving method according to claim 12, wherein a time width of the open state of the second switch is controlled according to the load capacity of the capacitive load.

17. The driving method according to claim 10, wherein the first current regenerating circuit includes a third switch, and, at the third time point, the regenerating to the DC power source of the current in the first flywheel operational state by opening the first switch is carried out such that, at the third time point, the third switch is closed, and the current in the first flywheel operational state is regenerated to the DC power source.

18. The driving method according to claim 10, wherein the second current regenerating circuit includes a fourth switch, and, at the sixth time point, the regenerating to the DC power source of the current in the second flywheel operational state by opening the second switch is carried out such that, at the sixth time point, the fourth switch is closed, and the current in the second flywheel operational state is regenerated to the DC power source.

19. The driving method according to claim 10, wherein the driving circuit of the capacitive load further includes a load capacity one end of which is connected between the coil and the capacitive load, and the other end is connected to the earth potential, and the current is passed from the load capacity to the capacitive load between the second time point and the third time point and between the fifth time point and the sixth time point.

20. The driving method according to claim 10, wherein the DC power source voltage is at a lower side than the earth potential, and, a charging voltage of the capacitive load is clamped at a DC power source voltage so as to stop the first resonance at the second time point at which the voltage of the capacitive load begins to fall below the DC power source voltage, and the current flowing through the coil at this time point is sustained in the first flywheel operational state, and, at the fifth time point at which the voltage of the capacitive load begins to exceed the earth potential, the voltage of the capacitive load is clamped at the earth potential so as to stop the second resonance, and the current flowing through the coil at this time point is sustained in the second flywheel operational state.

21. A driving circuit for a capacitive load, which supplies a pulse to the capacitive load that is an electrode of a capacitive display panel, the driving circuit comprising:

a coil connected directly or indirectly to the capacitive load and making up a serial resonance circuit together with the capacitive load;

a first diode connected so that the direction from the coil to the DC power source is a forward direction between one end of the coil on a side of the capacitive load and the DC power source;

a second diode connected so that the direction from an earth terminal to the coil is a forward direction between the end of the coil and the earth terminal;

a third diode connected so that a direction from the coil to the DC power source is a forward direction between the other end of the coil and the DC power source;

a first switch connected in parallel with the third diode;

a fourth diode connected so that a direction from the earth terminal to the coil is a forward direction between the other end of the coil and an earth terminal; and a second switch connected in parallel with the fourth diode; and a control circuit that control the operations of the first and second switches.

22. The driving circuit according to claim 21, wherein a parallel connection part of the third diode and the first switch and a parallel connection part of the fourth diode and the second switch are each constructed by a MOSFET including a parasitic diode.

* * * * *

UNITED STATES PATENT AND TRADEMARK OFFICE

CERTIFICATE OF CORRECTION

PATENT NO. : 6,366,063 B1
DATED : April 2, 2002
INVENTOR(S) : Yoshizumi Sekii

It is certified that error appears in the above-identified patent and that said Letters Patent is hereby corrected as shown below:

Title page,
Item [30], Foreign Application Priority Data, "12-081066" should be changed to -- 2000-081066 --.

Signed and Sealed this

Twenty-fourth Day of September, 2002

*Attest:*

*Attesting Officer*

JAMES E. ROGAN
*Director of the United States Patent and Trademark Office*